US012449190B2

(12) United States Patent
Yang et al.

(10) Patent No.: US 12,449,190 B2
(45) Date of Patent: Oct. 21, 2025

(54) REFRIGERATOR

(71) Applicant: LG Electronics Inc., Seoul (KR)

(72) Inventors: Chang Woan Yang, Seoul (KR); Seung-Jin Oh, Seoul (KR); Kihyun Park, Seoul (KR); Giyoung Kim, Seoul (KR); Seong Jin Na, Seoul (KR)

(73) Assignee: LG Electronics Inc., Seoul (KR)

( * ) Notice: Subject to any disclaimer, the term of this patent is extended or adjusted under 35 U.S.C. 154(b) by 444 days.

(21) Appl. No.: 17/776,919

(22) PCT Filed: Nov. 13, 2020

(86) PCT No.: PCT/KR2020/015998

§ 371 (c)(1),
(2) Date: May 13, 2022

(87) PCT Pub. No.: WO2021/096291

PCT Pub. Date: May 20, 2021

(65) Prior Publication Data

US 2022/0397330 A1 Dec. 15, 2022

(30) Foreign Application Priority Data

Nov. 13, 2019 (KR) ..... 10-2019-0145421
Nov. 13, 2019 (KR) ..... 10-2019-0145423
Mar. 4, 2020 (KR) ..... 10-2020-0027417

(51) Int. Cl.

*F25D 23/06* (2006.01)
*F25D 23/02* (2006.01)
*F25D 11/02* (2006.01)
*F25D 23/08* (2006.01)

(52) U.S. Cl.

CPC ..... *F25D 23/062* (2013.01); *F25D 23/065* (2013.01); *F25D 23/069* (2013.01); *F25D 11/02* (2013.01); *F25D 23/085* (2013.01); *F25D 2400/04* (2013.01)

(58) Field of Classification Search

CPC .. F25D 23/069; F25D 23/062; F25D 2400/04; F25D 11/02; F25D 23/065

See application file for complete search history.

(56) References Cited

U.S. PATENT DOCUMENTS 3,380,615 A * 4/1968 Kessler ..... F25D 23/085 220/592.06
3,405,986 A 10/1968 Cannon
4,134,627 A 1/1979 Kuskowski
(Continued)

FOREIGN PATENT DOCUMENTS

JP S4323796 Y1 10/1968
JP S442850 Y1 2/1969
(Continued)

OTHER PUBLICATIONS

EP Extended European Search Report in European Appln. No. 20888010.4, mailed on Oct. 30, 2023, 8 pages.
(Continued)

*Primary Examiner* — Kimberley S Wright
(74) *Attorney, Agent, or Firm* — Fish & Richardson P.C.

(57) ABSTRACT

A refrigerator includes a front frame part that defines a part of a front surface exterior and is installed on a front side of an outer casing that defines an outer appearance of the refrigerator.

15 Claims, 37 Drawing Sheets

(56) References Cited

U.S. PATENT DOCUMENTS

| | | | | |
|---|---|---|---|---|
| 4,822,117 | A * | 4/1989 | Boston, Jr. | F25D 23/062 29/455.1 |
| 9,429,357 | B2 * | 8/2016 | Cha | B23P 15/26 |
| 9,810,477 | B2 * | 11/2017 | Sul | F25D 23/065 |
| 10,753,669 | B2 * | 8/2020 | Dherde | F25D 23/065 |
| 10,907,890 | B2 * | 2/2021 | Deka | F25D 23/069 |
| 11,243,023 | B2 * | 2/2022 | Deka | F25D 23/062 |
| 2011/0011121 | A1 * | 1/2011 | Kim | F25D 23/065 62/449 |
| 2011/0023529 | A1 * | 2/2011 | Kim | F25D 23/021 62/449 |
| 2016/0102905 | A1 * | 4/2016 | Cha | F25D 23/069 312/406.1 |
| 2016/0282035 | A1 * | 9/2016 | Sul | F25D 23/065 |
| 2018/0180350 | A1 * | 6/2018 | Yoon | F25D 23/063 |
| 2019/0101320 | A1 * | 4/2019 | Dherde | F25D 23/069 |
| 2019/0120544 | A1 * | 4/2019 | Deka | F25D 23/025 |
| 2021/0102747 | A1 * | 4/2021 | Deka | F25D 23/065 |
| 2021/0325106 | A1 * | 10/2021 | Marinello | F25D 23/085 |
| 2022/0099359 | A1 * | 3/2022 | Deka | F25D 23/025 |

FOREIGN PATENT DOCUMENTS

| | | | | |
|---|---|---|---|---|
| JP | S4622 | U | | 9/1971 |
| JP | S4920162 | U | | 2/1974 |
| JP | S57201497 | | | 12/1982 |
| JP | 2005257087 | A | * | 9/2005 |
| KR | 20-1998-0013732 | U | | 6/1998 |
| KR | 10-2004-0042973 | A | | 5/2004 |
| KR | 10-2016-0115445 | A | | 10/2016 |
| KR | 10-2018-0054538 | A | | 5/2018 |
| KR | 101870899 | | | 6/2018 |

OTHER PUBLICATIONS

Office Action in Korean Appln. No. 10-2019-0145423, mailed on Jan. 20, 2025, 13 pages.

Office Action in Korean Appln. No. 10-2019-0145421, mailed on Feb. 10, 2025, 11 pages.

* cited by examiner

REFRIGERATOR

CROSS-REFERENCE TO RELATED APPLICATIONS

This application is a National Stage application under 35 U.S.C. § 371 of International Application No. PCT/KR2020/015998, filed on Nov. 13, 2020, which claims the benefit of Korean Patent Application No. 10-2019-0145421, filed on Nov. 13, 2019, Korean Patent Application No. 10-2019-0145423, filed on Nov. 13, 2019, and Korean Patent Application No. 10-2020-0027417, filed on Mar. 4, 2020. The disclosures of the prior applications are incorporated by reference in their entirety.

TECHNICAL FIELD

The present disclosure relates to a refrigerator and, more particularly, to a refrigerator in which a front frame part is installed on a front surface of an outer casing to form a beautiful appearance on a front of the refrigerator.

BACKGROUND ART

In general, a refrigerator is a device that keeps food fresh for a certain period of time by lowering temperature inside a refrigerating chamber and a freezing chamber, as a refrigerant repeats a freezing cycle of compression, condensation, expansion, and evaporation.

To this end, the refrigerator is configured to include: a compressor for compressing a refrigerant; a condenser for condensing the refrigerant introduced from the compressor by outside air; an expansion valve for depressurizing the refrigerant introduced from the condenser; and an evaporator for absorbing heat in the refrigerator as the refrigerant that has passed through the expansion valve is evaporated in a low pressure state.

In addition, the refrigerator includes: a main body that forms a storage space therein separated into a refrigerating chamber and a freezing chamber; and a door that opens and closes the refrigerating chamber and the freezing chamber from a front of the main body, wherein the main body is provided with a machine chamber formed therein so that the compressor and the condenser are built into the machine chamber.

In addition, generally, an assembly structure of the main body of the refrigerator mostly use a structure in which upper and lower storage chambers are disposed inside a cabinet, and a front edge part of the cabinet and front edge parts of the respective upper and lower storage chambers are directly assembled.

The assembly structure regarding the cabinet and the upper and lower storage chambers of the main body of the refrigerator is disclosed in Korean Patent Application Publication No. 10-2000-0060269 and Korean Patent Application Publication No. 10-2006-0068721.

In Korean Patent Application Publication No. 10-2000-0060269, there is disclosed a refrigerator, comprising: protrusion parts respectively formed to protrude inward from opposite side walls of a main body at predetermined intervals; and a barrier mounted between the protrusion parts and configured to divide the interior of the refrigerator into a first chamber and a second chamber.

A conventional refrigerator is configured to provide a refrigerator capable of reliably performing thermal insulation of each chamber, easily assembling a barrier, and of which the internal chambers have an excellent appearance.

However, referring to FIGS. 4 and 5 of the conventional refrigerator, various assembly seams (i.e. assembly seams generated in the process of assembling different parts) that are generated on an edge part of a front surface of the refrigerator due to the mutual coupling of the parts are exposed to the outside in a process of assembling the cabinet (i.e. an outer casing) shaping the refrigerator exterior, the first and second chambers, and the barrier.

As such assembly seam lines are exposed to the outer side of the front surface of the refrigerator, there is a problem in that when the door of the refrigerator is opened, a front surface part of the refrigerator is exposed to the outside, thereby deteriorating the appearance of the refrigerator.

In Korean Patent Application Publication No. 10-20060068721, there is disclosed a refrigerator in which a refrigeration casing and a base board casing are configured in a non-integral coupled structure, and a foaming liquid is prevented from being leaked from the refrigeration casing and from a coupling gap between the refrigeration casing and the base board casing.

However, referring to FIG. 1 of the conventional refrigerator, the parts including a casing, a refrigerating chamber, a base board part, and a bent part are assembled with each other along a front side edge part of the refrigerator through a complicated assembly process.

Accordingly, the conventional refrigerator has problems in that assembly time increases and productivity decreases as the parts are assembled with each other through the complicated assembly process, and complex assembly seam lines are generated along an edge part of the front surface of the refrigerator in the process of assembling different parts in the front surface part of the refrigerator.

DISCLOSURE

Technical Problem

The present disclosure has been devised to solve the problems according to the related art described above, and an objective of the present disclosure is to provide a refrigerator having a beautiful appearance, as a separate front frame part configured to form a front surface exterior is installed on a front side of an outer casing of the refrigerator.

Another objective of the present disclosure is to provide a refrigerator in which assembly of the refrigerator is easy, as inner surfaces of a first storage chamber and a second storage chamber are fitted and fixed to a storage chamber coupling end and auxiliary coupling ends, which are formed on a rear surface part of a front frame part.

In addition, yet another objective of the present disclosure is to provide a refrigerator having an assembly structure in which middle exterior frame mounting holes are respectively formed in centers of second edge ends to allow opposite sides of the middle exterior frame to be inserted therein, so that the middle exterior frame may be easily assembled to a front frame.

In addition, still another objective of the present disclosure is to provide a refrigerator in which corner parts having a beautiful exterior may be formed in an opening part of a front frame, as corner ends respectively formed in an arc shape on opposite sides of each auxiliary coupling end are formed.

In addition, still another objective of the present disclosure is to provide a refrigerator in which a frame fixing protrusion of a middle exterior frame is screw-coupled to a screw fastening protrusion of a front frame, so that the middle exterior frame may be firmly fixed to the front frame.

In addition, still another objective of the present disclosure is to provide a refrigerator in which insertion depth adjustment jaws are formed on an outer surface of a storage chamber coupling end, so that insertion depths of first and second storage chambers may be adjusted when the first and second storage chambers are inserted into the storage chamber coupling end.

In addition, still another objective of the present disclosure is to provide a refrigerator in which as a barrier module is installed inside an inner casing and the inner casing is partitioned into independent spaces of a first storage chamber and a second storage chamber, the first storage chamber and the second storage chamber may be used independently.

In addition, still another objective of the present disclosure is to provide a refrigerator in which as a cold air blocking member is installed on a lower part of a barrier module to block a space between a door and the barrier module, the circulation of cold air in the first and second storage chambers may be prevented.

In addition, still another objective of the present disclosure is to provide a refrigerator in which a shielding member is installed on a lower part of a middle exterior frame to block cold air flowing to an upper side of a rear surface of a door, so as to prevent dew condensation from occurring on an upper part of the door.

Technical Solution

According to features of the present disclosure for achieving the above-described objectives, a refrigerator according to the present disclosure proposes that a front frame part for a front surface exterior may be additionally installed on a front side of an outer casing, and allows that the separate front frame part may be installed on a front surface of the outer casing so that a beautiful appearance may be formed on the front surface of the outer casing.

In addition, the refrigerator according to the present disclosure proposes that inner surfaces of first and second storage chambers may be fitted and coupled to a storage chamber coupling end and auxiliary coupling ends, which are formed on a rear surface part of the front frame part, and allows that an operator may easily assemble the first and second storage chambers on the rear surface part of the front frame part with a simple operation In addition, the refrigerator according to the present disclosure proposes that the refrigerator has an assembly structure in which middle exterior frame mounting holes may be respectively formed in centers of second edge ends to allow opposite sides of a middle exterior frame to be inserted therein, and allows that the middle exterior frame may be firmly assembled to a front frame.

In addition, the refrigerator according to the present disclosure proposes that corner ends respectively formed in an arc shape on opposite sides of each auxiliary coupling end are formed, and allows that corner parts having a beautiful exterior may be formed in an opening part of the front frame.

In addition, the refrigerator according to the present disclosure proposes that a frame fixing protrusion of the middle exterior frame may be screw-coupled to a screw fastening protrusion of the front frame, and allows that the middle exterior frame may be firmly fixed to the front frame.

In addition, the refrigerator according to the present disclosure proposes that insertion depth adjustment jaws may be formed on an outer surface of the storage chamber coupling end, and allows that insertion depths of the first and second storage chambers may be adjusted when the first and second storage chambers are inserted into the storage chamber coupling end.

In addition, the refrigerator according to the present disclosure allows that the first and second storage chambers may be used independently, as a barrier module is installed inside an inner casing to partition the inner casing into independent spaces of the first and second storage chambers.

In addition, the refrigerator according to the present disclosure proposes that a cold air blocking member may be installed on a lower part of the barrier module, and allows that circulation of cold air in the first and second storage chambers may be prevented from occurring through a space between a door and the barrier module.

In addition, the refrigerator according to the present disclosure allows that a shielding member may be installed on a lower part of the middle exterior frame to block cold air flowing to an upper side of a rear surface of the door, so as to prevent dew condensation from occurring on an upper part of the door.

Advantageous Effects

As described above, in the refrigerator of the present disclosure, there is an effect that as the front frame part for the front surface exterior is additionally installed on the front side of the outer casing, a beautiful appearance is formed on the front surface of the outer casing.

In addition, as the inner surfaces of the first and second storage chambers are fitted and coupled to the storage chamber coupling end and the auxiliary coupling ends, which are formed on the rear surface part of the front frame part, an operator may easily assemble the first and second storage chambers on the rear surface part of the front frame part with a simple operation, whereby there is an effect of reducing the assembly time of the refrigerator and improving the assembly efficiency of the refrigerator.

In addition, the refrigerator has an assembly structure in which the middle exterior frame mounting holes are respectively formed in the centers of the second edge ends to allow the opposite sides of the middle exterior frame to be inserted therein, so that the middle exterior frame may be easily assembled to the front frame, whereby there is an effect of improving the assembling property of the refrigerator.

In addition, as the middle frame locking ends are formed at opposite ends of a middle frame body, the middle exterior frame assembled to the front frame is prevented from being separated toward a front side of the front frame, whereby there is an effect that assembly of the middle exterior frame to the front frame is easy.

In addition, as screw coupling protrusions of the middle exterior frame are respectively screw-coupled to screw fastening protrusions of the front frame, the middle exterior frame may be firmly fixed to the front frame, whereby there is an effect of improving the fixing force between the parts of the refrigerator.

In addition, as insertion depth adjustment jaws are formed on the outer surface of the storage chamber coupling end, the insertion depths of the first and second storage chambers may be adjusted in the storage chamber coupling end, whereby there is an advantage in that the assembling property of the refrigerator is improved.

In addition, as the barrier module is installed inside the inner casing to partition the inner casing into independent spaces of the first and second storage chambers, there is an advantage in that the first and second storage chambers may be used independently.

In addition, as a cold air blocking member is installed on the lower part of the barrier module, the circulation of cold air in the first and second storage chambers may be prevented from occurring through the space between the door and the barrier module, whereby there is an advantage in that the first and second storage chambers are completely partitioned and may be used as the first and second storage chambers having different refrigerating or freezing temperatures.

In addition, as the shielding member is installed on the lower part of the middle exterior frame to prevent the cold air circulating in the second storage chamber from flowing toward the upper side of the rear surface of the door, there is an effect of preventing a dew condensation phenomenon occurring on the upper part of the door.

MODE FOR INVENTION

Hereinafter, a preferred exemplary embodiment of a refrigerator according to the present disclosure will be described in detail with reference to the accompanying drawings.

Figure 1:
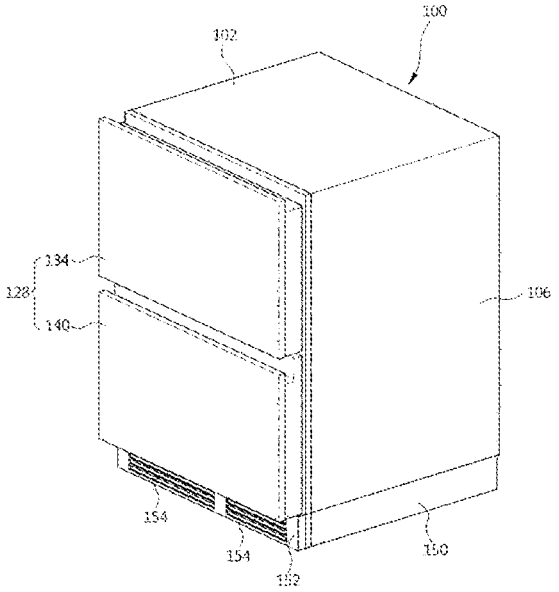
FIG. 1 is a perspective view illustrating a configuration of a preferred exemplary embodiment of a refrigerator according to the present disclosure.
Figure 2:
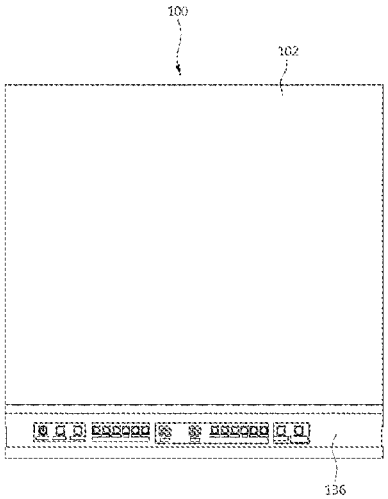
FIG. 2 is a plan view illustrating the configuration of the preferred exemplary embodiment of the refrigerator according to the present disclosure.
Figure 3:
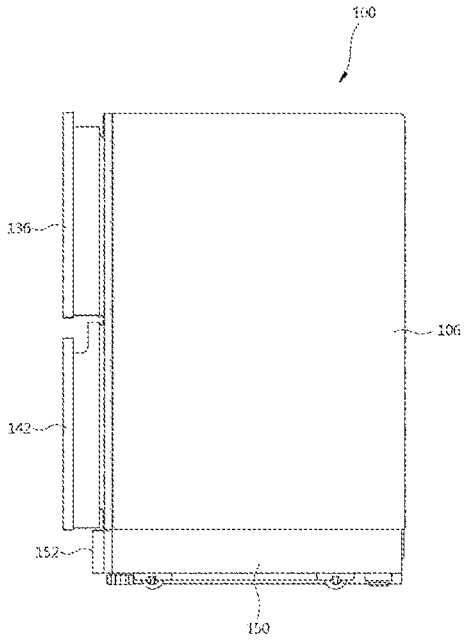
FIG. 3 is a side view illustrating the configuration of the preferred exemplary embodiment of the refrigerator according to the present disclosure.
Figure 4:
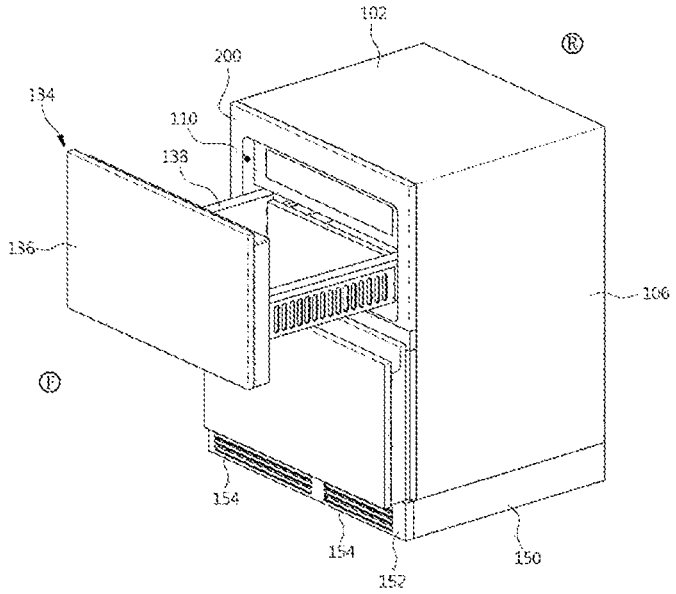
FIG. 4 is a front perspective view illustrating a state in which a first drawer part constituting the exemplary embodiment of the present disclosure is withdrawn to outside of a first storage chamber.
Figure 5:
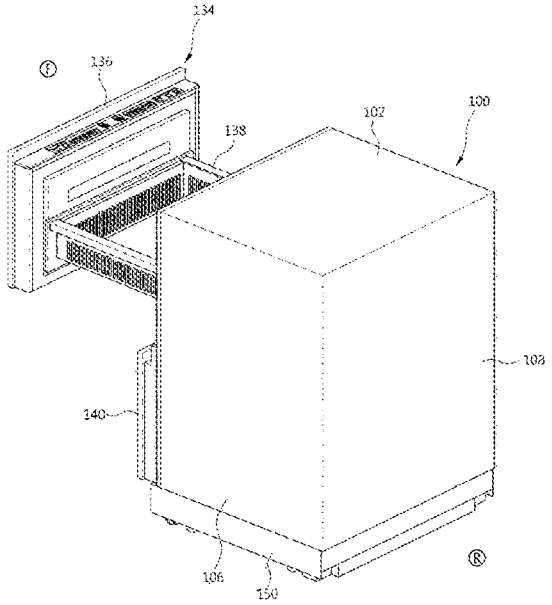
FIG. 5 is a rear perspective view illustrating the state in which the first drawer part constituting the exemplary embodiment of the present disclosure is withdrawn to the outside of the first storage chamber.
Figure 6:
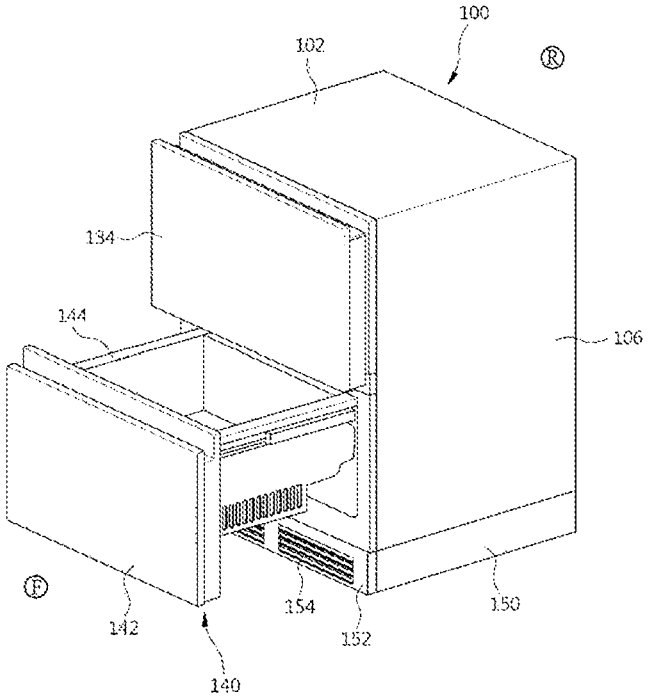
FIG. 6 is a front perspective view illustrating a state in which a second drawer part constituting the exemplary embodiment of the present disclosure is withdrawn to outside of a second storage chamber.

FIG. 1 is a perspective view illustrating a configuration of a preferred exemplary embodiment of a refrigerator according to the present disclosure. FIG. 2 is a plan view illustrating the configuration of the preferred exemplary embodiment of the refrigerator according to the present disclosure. FIG. 3 is a side view illustrating the configuration of the preferred exemplary embodiment of the refrigerator according to the present disclosure. FIG. 4 is a front perspective view illustrating a state in which a first drawer part constituting the exemplary embodiment of the present disclosure is withdrawn to outside of a first storage chamber. FIG. 5 is a rear perspective view illustrating the state in which the first drawer part constituting the exemplary embodiment of the present disclosure is withdrawn to the outside of the first storage chamber. FIG. 6 is a front perspective view illustrating a state in which a second drawer part constituting the exemplary embodiment of the present disclosure is withdrawn to the outside of a second storage chamber.

The exemplary embodiments of the refrigerator of the present disclosure will be described with reference to the drawings. For reference, a built-in type refrigerator has been described below as an example, but the refrigerator of the present disclosure may be applied to various devices such as a general refrigerator, a wine refrigerator, a kimchi refrigerator, a beverage storage, and a plant cultivation device.

The refrigerator according to the exemplary embodiment of the present disclosure will be described for each configuration described above.

First, an outer casing 100 of the refrigerator according to the exemplary embodiment of the present disclosure will be described.

The outer casing 100 is a part that forms an exterior of the refrigerator.

Such an outer casing 100 includes: an upper side part 102 configured to form an upper side wall, a bottom part 104 configured to form a lower side wall, two sidewall parts 106 configured to form opposite side walls, and a rear wall 108 configured to form a rear side wall.

In addition, the outer casing 100 is configured to include a box body open to a front thereof. In this case, an inner space of the outer casing 100 is provided as a storage space 110.

An inner casing 112 is installed inside the storage space 110 of the outer casing 100. The inner casing 112 includes a first inner casing 114 and a second storage chamber 116, which are respectively installed in upper and lower spaces of the outer casing 100.

The first inner casing 114 is formed in a chamber shape having an open front, and is installed in the upper storage space 110 of the outer casing 100. The interior of the first inner casing 114 is a part in which cold air is circulated and food or food containers are stored.

A second inner casing 116 is installed below the first storage chamber 114. The second inner casing 116 is formed in a chamber shape having an open front, and is installed in the lower storage space 110 of the outer casing 100. The interior of the second inner casing 116 is a part in which the cold air is circulated as in the first inner casing 114 and food or food containers are stored.

That is, the storage space 110 of the outer casing 100 is divided into the first inner casing 114 and second storage chamber 116, and the first and second inner casings 114 and 116 may be respectively used as refrigerating chambers or freezing chambers, which are independent spaces.

A coupling part 113 is formed on a front edge part of each of the first inner casing 114 and the second storage chamber 116. The coupling parts 113 are formed to extend outward from along the respective open front edge parts of the first and second inner casings 114 and 116. The inner part of the coupling part 113 is a part to which a storage chamber coupling end 208, which will be described later, is inserted and fixed.

In addition, the first inner casing 114 is divided into a first cold air circulation space 120 and a first cold air generation space 122. The first cold air circulation space 120 is a part where a first drawer part 134 to be described later is made to slide horizontally in and out, and the first cold air generation space 122 is a part where an evaporator (not shown) is installed to generate cold air.

The first cold air circulation space 120 and the first cold air generation space 122 are partitioned by a grill plate 123.

In addition, the second inner casing 116 is divided into a second cold air circulation space 124 and a second cold air generation space 126. The second cold air circulation space 124 is a part where a lower drawer part 140 to be described later is made to slide horizontally in and out, and the second cold air generation space 126 is a part in which an evaporator is installed.

The second cold air circulation space 124 and the second cold air generation space 126 are partitioned by a grill plate 123.

A drawer part 128 including a door 130 and a drawer body 132 is installed in the interior of each of the first and second inner casings 114 and 116. The drawer parts 128 are respectively installed in the first and second inner casings 114 and 116. Here, it will be described such that a drawer part 128 installed in the first inner casing 114 is called as a first drawer part 134, and a drawer part 128 installed in the second inner casing 116 is called as a second drawer part 140.

The first drawer part 134 is installed in the interior of the first storage chamber 114. The first drawer part 134 is configured to include a first door 136, a first drawer body 138, etc.

The first drawer part 134 is formed in a drawer shape, and is installed to be slidable horizontally in and out of the interior of the first storage chamber 114. The interior of the first drawer part 134 is a part in which food and food containers are stored and kept.

The second drawer part 140 is installed in the interior of the second storage chamber 116. The second drawer part 140 is configured to include a second door 142, a second drawer body 144, etc.

The second drawer part 140 is formed in a drawer shape, and is installed to be slidable horizontally in and out of the interior of the second storage chamber 116. The interior of the second drawer part 140 is a part in which food and food containers are stored and kept.

Drawer rails (not shown) are respectively installed on opposite sides of the first and second drawer parts 134 and 140. The drawer rails installed on the opposite sides of the first and second drawer parts 134 and 140 are general drawer rails and a detailed description thereof will be omitted. Retracting and withdrawing operations of the first and second drawer parts 134 and 140 may be performed by the drawer rails.

As described above, the first drawer part 134 and the second drawer part 140 are respectively disposed on the upper and lower sides of the storage space 110, and are installed so that the first and second inner casings 114 and 116 can be withdrawn to the outside according to a user's operation.

A machine chamber 150 is installed in a lower part of the outer casing 100. The machine chamber 150 is formed in a chamber shape having an open front side thereof, and is provided with a plurality of parts installed therein. The interior of the machine chamber 150 is a part in which various refrigeration parts, such as a compressor (not shown) and a condenser (not shown), of the refrigerator, and PCB modules (not shown) are installed.

A grill cover 152 is installed on a front surface of the machine chamber 150. The grill cover 152 serves to guide a flow of air suctioned into the machine chamber 150 from the outside of the machine chamber 150 or a flow of air discharged from the inside of the machine chamber 150 to the outside of the machine chamber 150, and to close the open front surface of the machine chamber 150.

A front surface of the grill cover 152 is provided with grill cover holes 154 formed to pass through forward and backward. The grill cover holes 154 are formed in a long hole shape, and are formed horizontally long. Each of a plurality of the grill cover holes 154 is formed side by side in a row on the left and right sides of the front surface of the grill cover 152.

The grill cover holes 154 are divided into an inlet-side grill cover hole 154 and an outlet-side grill cover hole 154. Relative to the front surface of the grill cover 152, the inlet-side grill cover hole 154 is formed on the left side, and the outlet-side grill cover hole 154 is formed on the right side.

The grill cover holes 154 are used as a passage for introducing external air into the inside of the machine chamber 150 or for discharging the air circulated inside the machine chamber 150 to the outside.

Figure 7:
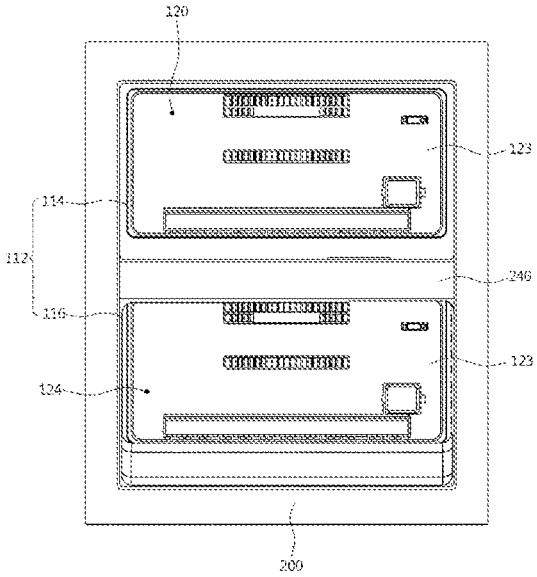
FIG. 7 is a front view illustrating a state in which a front frame part is installed on a front side of an outer casing constituting the exemplary embodiment of the present disclosure.
Figure 8:
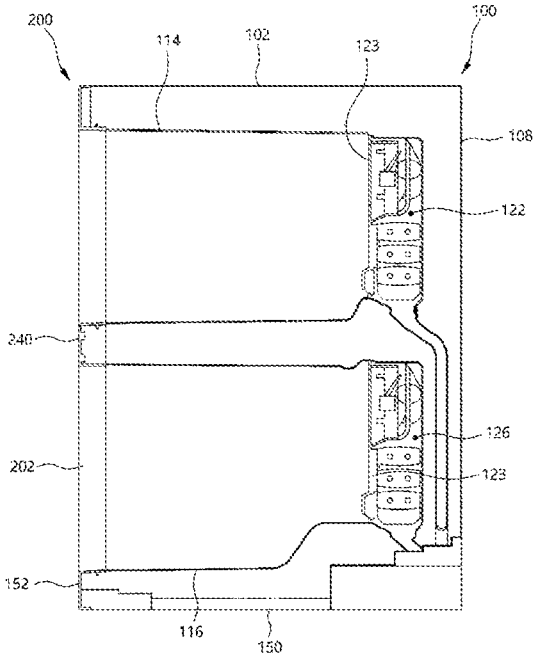
FIG. 8 is a cross-sectional view illustrating a state in which the front frame part is installed on the front side of the outer casing constituting the exemplary embodiment of the present disclosure.
Figure 9:
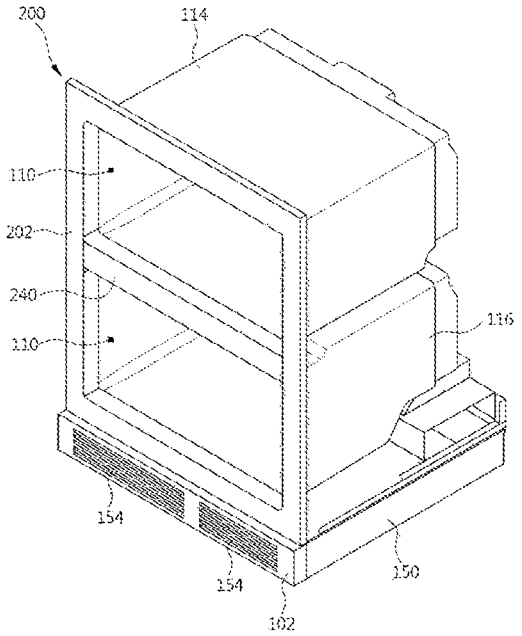
FIG. 9 is a front perspective view illustrating a state in which the first storage chamber and the first storage chamber are mounted on the front frame part constituting the exemplary embodiment of the present disclosure.
Figure 10:
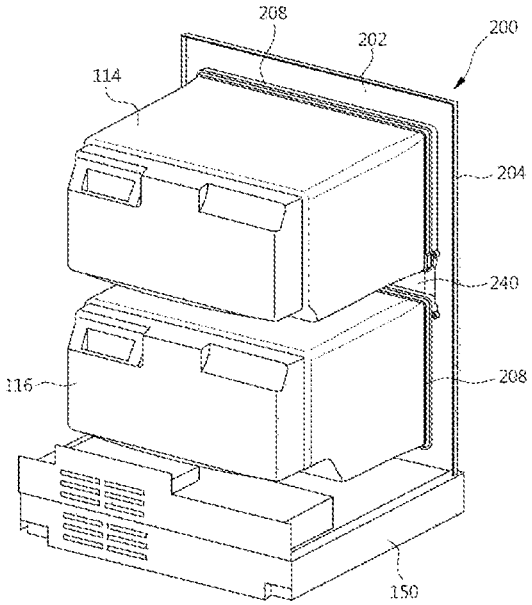
FIG. 10 is a rear perspective view illustrating a state in which the first storage chamber and the second storage chamber are mounted on the front frame part constituting the exemplary embodiment of the present disclosure.
Figure 11:
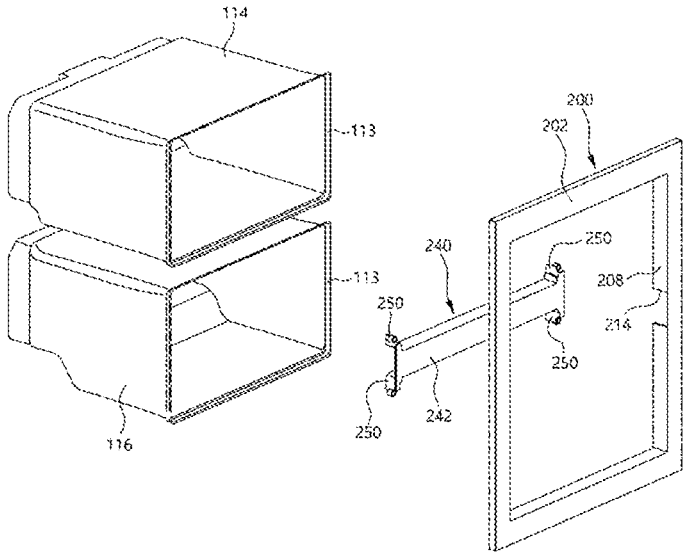
FIG. 11 is a front exploded perspective view illustrating a state in which the front frame part and the first and second storage chambers constituting the exemplary embodiment of the present disclosure are separated.
Figure 12:
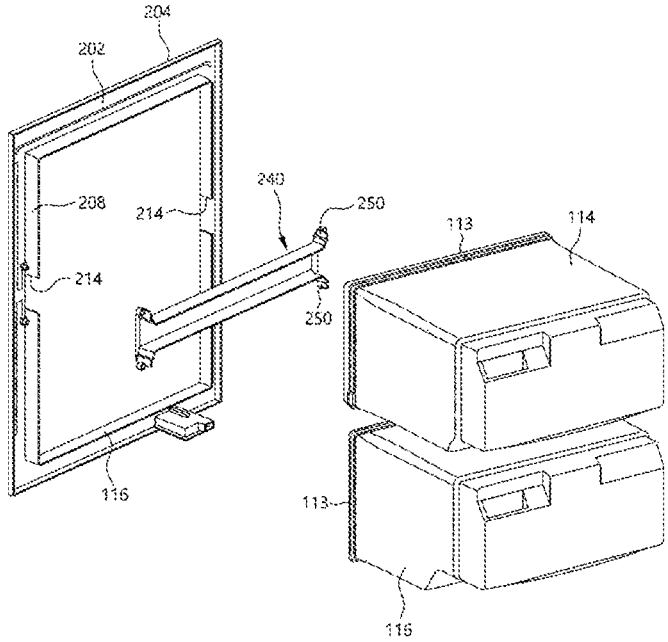
FIG. 12 is a rear exploded perspective view illustrating a state in which the front frame part and the first and second storage chambers constituting the exemplary embodiment of the present disclosure are separated.
Figure 13:
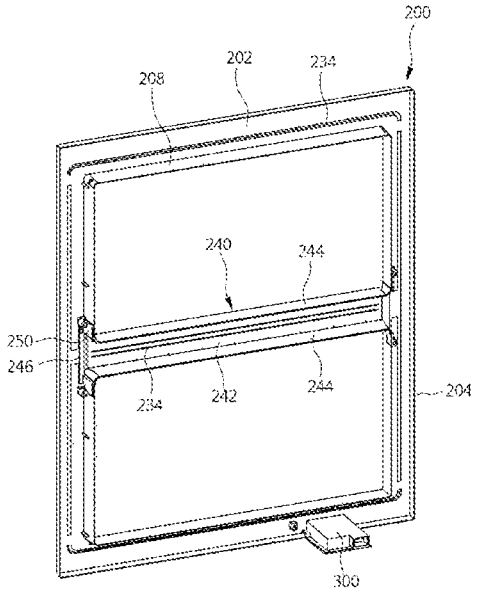
FIG. 13 is a rear perspective view illustrating a configuration of the front frame part constituting the exemplary embodiment of the present disclosure.
Figure 14:
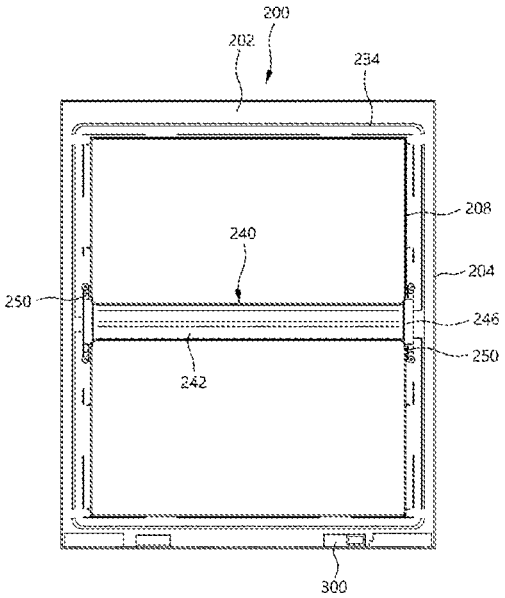
FIG. 14 is a rear view illustrating the configuration of the front frame part constituting the exemplary embodiment of the present disclosure.
Figure 15:
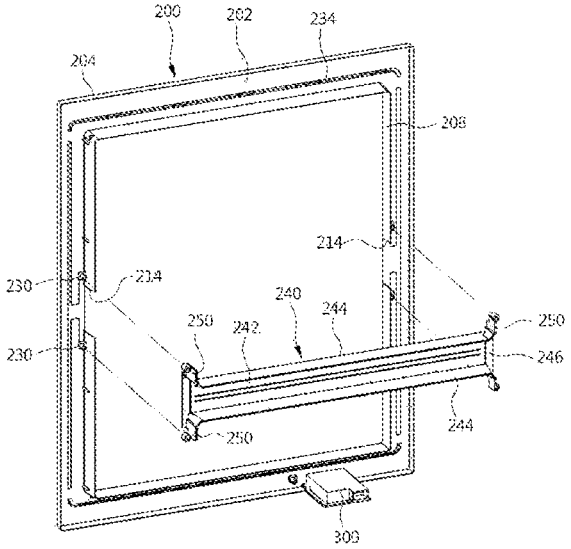
FIG. 15 is an exploded view illustrating the configuration of the front frame part constituting the exemplary embodiment of the present disclosure.
Figure 16:
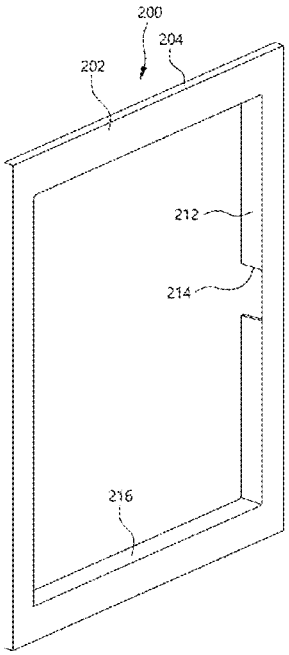
FIG. 16 is a front perspective view illustrating the configuration of the front frame constituting the exemplary embodiment of the present disclosure.
Figure 17:
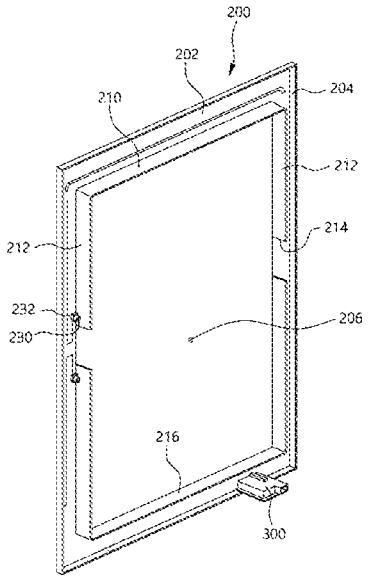
FIG. 17 is a rear perspective view illustrating the configuration of the front frame constituting the exemplary embodiment of the present disclosure.
Figure 18:
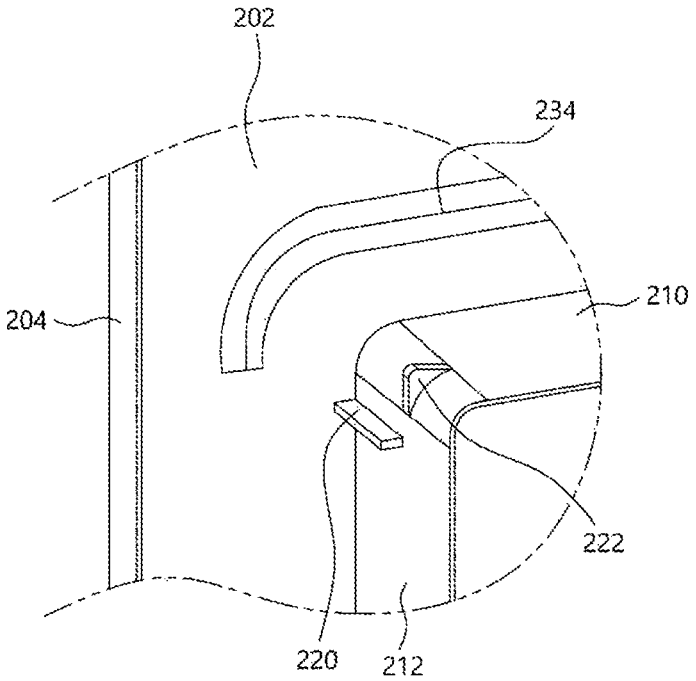
FIG. 18 is an enlarged perspective view illustrating a configuration of an insertion depth adjustment jaw and a corner part adjustment jaw constituting the exemplary embodiment of the present disclosure.

FIG. 7 is a front view illustrating a state in which a front frame part is installed on a front side of an outer casing constituting the exemplary embodiment of the present disclosure. FIG. 8 is a cross-sectional view illustrating a state in which the front frame part is installed on the front side of the outer casing constituting the exemplary embodiment of the present disclosure. FIG. 9 is a front perspective view illustrating a state in which the first storage chamber and the first storage chamber are mounted on the front frame part constituting the exemplary embodiment of the present disclosure. FIG. 10 is a rear perspective view illustrating a state in which the first storage chamber and the second storage chamber are mounted on the front frame part constituting the exemplary embodiment of the present disclosure. FIG. 11 is a front exploded perspective view illustrating a state in which the front frame part and the first and second storage chambers constituting the exemplary embodiment of the present disclosure are separated. FIG. 12 is a rear exploded perspective view illustrating a state in which the front frame part and the first and second storage chambers constituting the exemplary embodiment of the present disclosure are separated. FIG. 13 is a rear perspective view illustrating a configuration of the front frame part constituting the exemplary embodiment of the present disclosure. FIG. 14 is a rear view illustrating the configuration of the front frame part constituting the exemplary embodiment of the present disclosure. FIG. 15 is an exploded view illustrating the configuration of the front frame part constituting the exemplary embodiment of the present disclosure. FIG. 16 is a front perspective view illustrating the configuration of the front frame constituting the exemplary embodiment of the present disclosure. FIG. 17 is a rear perspective view illustrating a configuration of the front frame constituting the exemplary embodiment of the present disclosure. FIG. 18 is an enlarged perspective view illustrating a configuration of an insertion depth adjustment jaw and a corner part adjustment jaw constituting the exemplary embodiment of the present disclosure.

Referring to FIGS. 7 to 18, a front frame part 200 of the refrigerator according to the exemplary embodiment of the present disclosure will be described in detail.

The refrigerator according to the present disclosure is proposed to include: an outer casing 100 configured to form an exterior; an inner casing 112 disposed inside the outer casing 100 and configured to have a storage chamber; a door 130 configured to open and close the storage chamber of the inner casing 112; and a front frame part 200 disposed in the front of the outer casing 100 and inner casing 112, and formed to have an opening part 206, wherein the outer casing 100 is disposed on an outer side edge of the front frame part 200, and the inner casing 112 is disposed on an inner side edge of the front frame part 200.

The front frame part 200 is configured to include: a front frame 202 formed in a square frame shape, and installed on a front side of the outer casing 100 to form a front side exterior of the outer casing 100; an opening part 206 formed to pass through forward and backward in a front surface of the front frame 202, and configured to communicate with an open part of the first inner casing 114 and an open part of the second storage chamber 116; an inner casing coupling end 208 formed to protrude rearward from along an inner side edge part of the opening part 206 and inserted into inner surfaces of the first inner casing 114 and the second storage chamber 116; a middle exterior frame 240 installed horizontally long in the center of the front frame 202, and configured to close a central side of the front frame 202; and the like.

As shown in FIGS. 16 and 17, the front frame 202 is formed with a rectangular frame having a predetermined thickness, and is installed on the front side of the outer casing 100. The front frame 202 is a part that is installed on the front side of the outer casing 100 to form the front exterior of the outer casing 100.

An outer casing coupling end 204 is formed on an outer side edge part of the front frame 202. As shown in FIG. 17, the outer casing coupling end 204 is formed to protrude rearward by a predetermined length from along the outer side edge part of the front frame 202. The outer casing coupling end 204 is formed to protrude rearward from each of the upper, lower, left, and right ends of the front frame 202, and is a part that connects to the front edge part of the outer casing 100.

An opening part 206 is formed in the front side of the front frame 202. The opening part 206 is formed in a rectangular shape and configured to pass through forward and backward in the front side of the front frame 202. The opening part 206 is a part formed to pass through forward and backward in the front frame 202 and through which the first and second drawer parts 134 and 140 are made to slide horizontally in and out.

The inner casing coupling end 208 is formed on the inner side edge part of the front frame 202. The inner casing coupling end 208 is configured to include: a first edge end 210 formed horizontally long along an upper side edge part of the opening part 206, and configured to protrude by a predetermined length to a rear side of the front frame 202; second edge ends 212 formed vertically long along left and right side edge parts of the opening part 206, and configured to protrude by a predetermined length to the rear side of the front frame 202; and a third edge end 216 formed horizontally long along a lower side edge part of the opening part 206, and configured to protrude by a predetermined length to the rear side of the front frame 202.

The first edge end 210 is formed to protrude rearward from along the upper side edge part of the opening part 206 of the front frame 202. The first edge end 210 is apart that is inserted into the front side of an inner upper surface of the first storage chamber 114.

That is, the inner surface of the first inner casing 114 is inserted into an outer surface of the first edge end 210 through the open part of the first storage chamber 114, so that the first inner casing 114 is fixed to the front frame 202.

The second edge ends 212 are respectively formed on opposite sides of the first edge end 210. The second edge ends 212 are formed to respectively protrude rearward from along the left and right side edge parts of the opening part 206 of the front frame 202. The second edge ends 212 are inserted into the inner side surfaces of the first and second inner casings 114 and 116, so as to serve to fix the first and second inner casings 114 and 116 to the front frame 202.

The third edge end 216 is formed at lower parts of the second edge ends 212. The third edge end 216 is formed to protrude rearward from along the lower side edge part of the opening part 206. The third edge end 216 is inserted into an inner lower surface of the second storage chamber 116, so as to serve to fix the second inner casing 116 to the front frame 202.

Middle exterior frame mounting holes 214 are formed in respective centers of the second edge ends 212. As shown in FIG. 17, the middle exterior frame mounting holes 214 are formed in a rectangular shape in the respective center parts of the second edge ends 212, and are formed to pass through leftward to rightward in the respective center parts of the second edge ends 212. The interiors of the middle exterior frame mounting holes 214 are parts where the opposite ends of the middle exterior frame 240 to be described later are respectively installed by penetration and fixed thereto.

Hereinafter, an insertion depth adjustment jaw 220 and a corner part adjustment jaw 222 according to the exemplary embodiment of the present disclosure will be described in detail.

Each insertion depth adjustment jaw 220 is formed on an outer surface of the storage chamber coupling end 208. As shown in FIG. 18, each insertion depth adjustment jaw 220 is formed with a rectangular plate, and is formed to protrude in a direction perpendicular to the outer surface of the storage chamber coupling end 208. The insertion depth adjustment jaws 220 are parts formed to protrude from the outer surface of the inner casing coupling end 208 to be respectively caught on the front edge parts of the first and second inner casings 114 and 116.

That is, when the open parts of the first and second inner casings 114 and 116 are inserted into the outer surface of the storage chamber coupling end 208, the insertion depth adjustment jaws 220 serve to prevent the inner surfaces of the first and second inner casings 114 and 116 from being inserted to the outer surface of the inner casing coupling end 208 more than a predetermined depth.

Each corner part of the inner casing coupling end 208 is formed with a corner part adjustment jaw 222. The corner part adjustment jaw 222 is formed with a triangular plate, and is formed to protrude from the corner part of the inner casing coupling end 208 in a diagonal direction. The corner part adjustment jaw 222 is formed to protrude in the diagonal direction at the same position as the position of the most end of the insertion depth adjustment jaw 220. The corner part adjustment jaw 222 is formed to protrude outward from the corner part of the storage chamber coupling end 208, and is a part caught by the front corner part of the first and second inner casings 114 and 116.

That is, when the corner parts of the first and second inner casings 114 and 116 are inserted into the outer surface of the storage chamber coupling end 208, the insertion depth adjustment jaws 220 serve to prevent the inner surfaces of the corner part side of the first and second inner casings 114 and 116 from being inserted to the outer surface of the inner casing coupling end 208 more than a predetermined depth.

As the insertion depth adjustment jaws 220 and the corner adjustment jaws 222 are formed on the outer surface of the inner casing coupling end 208 as described above, the inner casing coupling end 208 may be prevented from being inserted into the first and second inner casings 114 and 116 more than the predetermined depth.

Screw fastening protrusions 230 are respectively formed at rear surface center parts of the front frame 202. Each screw fastening protrusion 230 is formed in a cylindrical shape, and is formed to protrude rearward from a rear surface part of the front frame 202. A screw fastening groove 232 is formed in the center of a rear surface of each screw fastening protrusion 230. The screw fastening protrusions 230 are formed to protrude rearward from upper and lower sides of the rear surface center parts of the front frame 202, and are parts where frame fixing protrusions 256 of the middle exterior frame 240 to be described later are coupled and fixed thereto.

A heating wire mounting groove 234 is formed on the rear surface part of the front frame 202. The heating wire mounting groove 234 is formed to be recessed in an arc shape along the rear surface part of the front frame 202. The interior of the heating wire mounting groove 234 is a part where a heating wire 260, which will be described later, is mounted and fixed therein.

Figure 19:
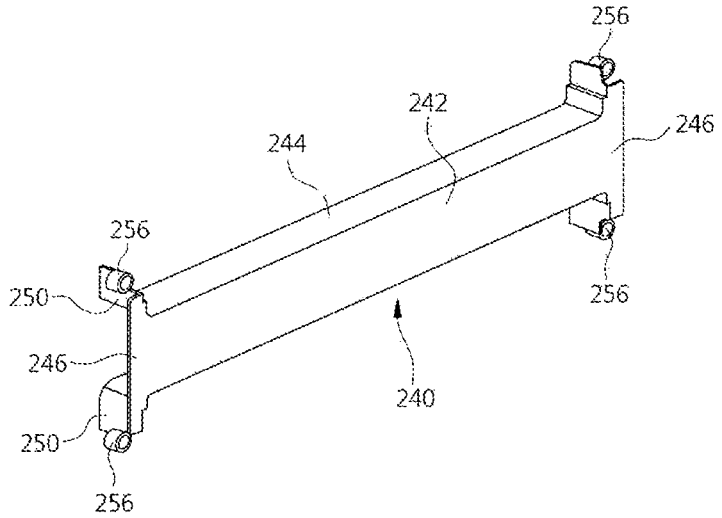
FIG. 19 is a front perspective view illustrating a configuration of a middle exterior frame constituting the exemplary embodiment of the present disclosure.
Figure 20:
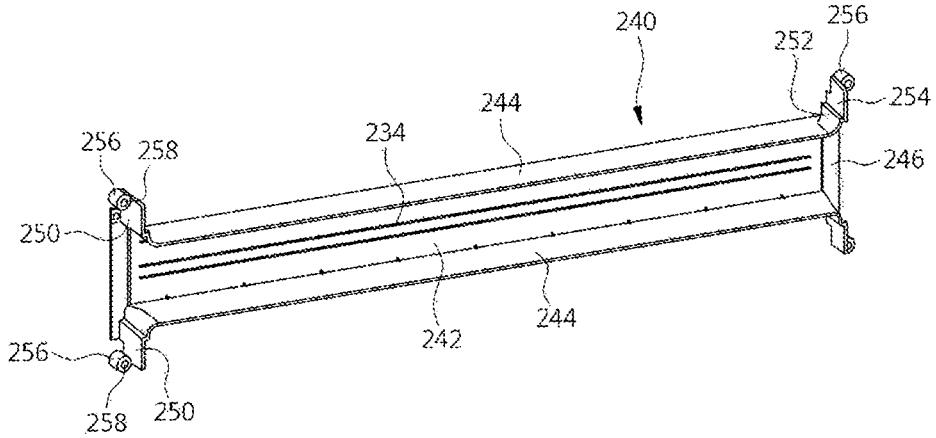
FIG. 20 is a rear perspective view illustrating the configuration of the middle exterior frame constituting the exemplary embodiment of the present disclosure.

FIG. 19 is a front perspective view illustrating a configuration of the middle exterior frame constituting the exemplary embodiment of the present disclosure. FIG. 20 is a rear perspective view illustrating the configuration of the middle exterior frame constituting the exemplary embodiment of the present disclosure.

Next, the middle exterior frame of the refrigerator according to the exemplary embodiment of the present disclosure will be described in detail with reference to FIGS. 19 and 20.

The middle exterior frame 240 is configured to include: a middle frame body 242 formed with a rectangular plate, formed horizontally long, and configured to close a central side of the opening part 206 of the front frame 202; auxiliary coupling ends 244 formed horizontally long at upper and lower ends of the middle frame body 242, and configured to protrude rearward of the middle frame body 242 and to be inserted into inner surfaces of the first and second inner casings 114 and 116; and the like.

The middle frame body 242 is installed horizontally long in the center of the opening part of the front frame 202. The middle frame body 242 serves to close a front side of a separation space between the first inner casing 114 and the second storage chamber 116.

The auxiliary coupling ends 244 are respectively formed at the upper and lower ends of the middle frame body 242. The auxiliary coupling ends 244 are formed horizontally long along the upper and lower end of the middle frame body 242, and are formed to protrude rearward of the middle frame body 242 by a predetermined length. The inner surfaces of the first and second inner casings 114 and 116 are respectively inserted into the outer surfaces of the auxiliary coupling ends 244.

That is, the inner lower surface of the first inner casing 114 is coupled to the auxiliary coupling end 244 positioned on an upper side of the middle frame body 242, and the inner upper surface of the second inner casing 116 is coupled to the auxiliary coupling end 244 positioned on a lower side of the middle frame body 242.

By a structure of such auxiliary coupling ends 244, the inner lower surface of the first inner casing 114 and the inner upper surface of the second inner casing 116 may be inserted and fixed to the middle frame body 242.

The middle frame locking ends 246 are formed on opposite sides of the middle frame body 242. The middle frame locking ends 246 are formed to extend in the leftward and rightward direction of the middle frame body 242, and are formed to protrude from along the front surface of the middle frame body 242 in an upward and downward direction.

The middle frame locking ends 246 are formed to respectively protrude from opposite sides of the middle frame body 242 in the leftward direction or the rightward direction, and are parts in close contact with the rear surface part of the front frame 202.

That is, the middle frame locking ends 246 are coupled to the rear surface part of the front frame 202 through the middle exterior frame mounting holes 214 respectively to serve to couple the middle frame body 242 to the front frame 202.

Corner part forming ends 250 are respectively formed at opposite ends of each auxiliary coupling end 244. Each corner part forming end 250 is configured to include a corner end 252 and a side surface fixing end 254. The corner ends 252 are respectively formed to extend from the opposite ends of each auxiliary coupling end 244, and are each formed with a wall having a curved shape, thereby being bent and formed from the opposite ends of each auxiliary coupling end 244 in an upward or downward direction.

The corner ends 252 are respectively formed at the opposite ends of each auxiliary coupling end 244, and are parts to which the front side lower corner parts of the first and second inner casings 114 and 116 are coupled and fixed.

The side surface fixing end 254 is formed at the end of each corner end 252. The side surface fixing end 254 is formed to extend vertically in the upward direction or downward direction from the end of each corner end 252. The side surface fixing ends 254 are coupled to the outer surfaces of the second edge ends 212 to fix the middle frame body 242 to the front frame 202.

The frame fixing protrusion 256 is formed at an end part of a side surface of each side surface fixing end 254. The screw coupling protrusion is formed in a cylindrical shape, and is integrally formed with the side surface fixing end 254. A screw fastening hole 258 is formed to pass through forward and backward in the center of a rear surface part of the frame fixing protrusion 256. A circumferential surface of each frame fixing protrusion 256 is fixed to a side surface of each side surface fixing end 254, and is coupled to a rear surface part of each screw fastening protrusion 230 when the middle exterior frame 240 is coupled to each middle exterior frame mounting hole 214.

Fastening screws (not shown) are coupled to the screw fastening protrusion 230 and frame fixing protrusion 256, so that the middle exterior frame 240 may be firmly fixed to the front frame 202.

A heating wire mounting groove 234 is formed on the rear surface part of the middle frame body 242. The heating wire mounting groove 234 is formed in an arc shape, and is formed to be recessed along the rear surface part of the middle frame body 242. The heating wire mounting grooves 234 are respectively formed on upper and lower sides of the rear surface part of the middle frame body 242, and each heating wire mounting groove 234 is a part into which a part of a heating wire 260, which will be described later, is inserted.

The heating wire 260 is mounted inside of the heating wire mounting groove 234. The heating wire 260 is a general heating line and a detailed description thereof will be omitted. The heating wire 260 is installed along the rear surface part of the front frame 202 and the rear surface part of the middle exterior frame 240, so as to serve to prevent a dew formation phenomenon that occurs in the front frame 202 and the middle exterior frame 240. (See FIG. 13)

Figure 21:
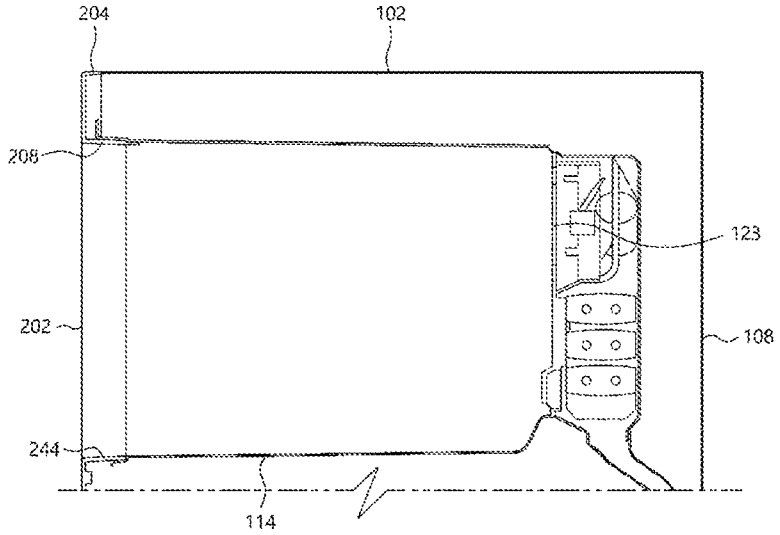
FIG. 21 is an enlarged cross-sectional view illustrating a state in which the first storage chamber is coupled to the front frame part constituting the exemplary embodiment of the present disclosure.
Figure 22:
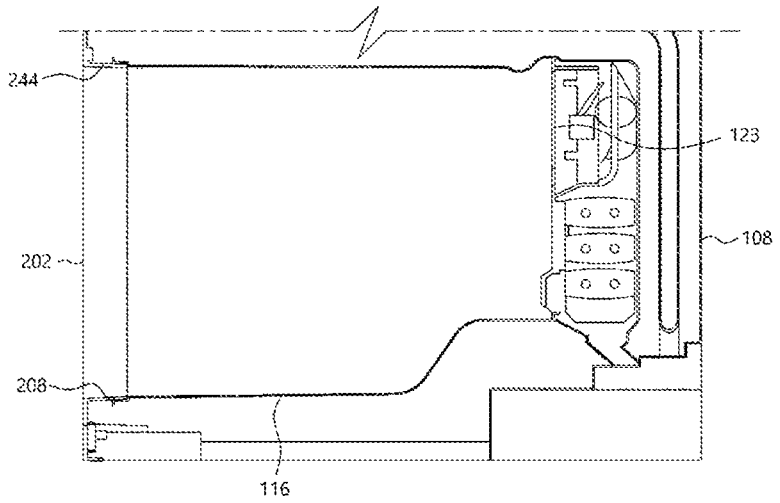
FIG. 22 is an enlarged cross-sectional view illustrating a state in which the second storage chamber is coupled to the front frame part constituting the exemplary embodiment of the present disclosure.
Figure 23:
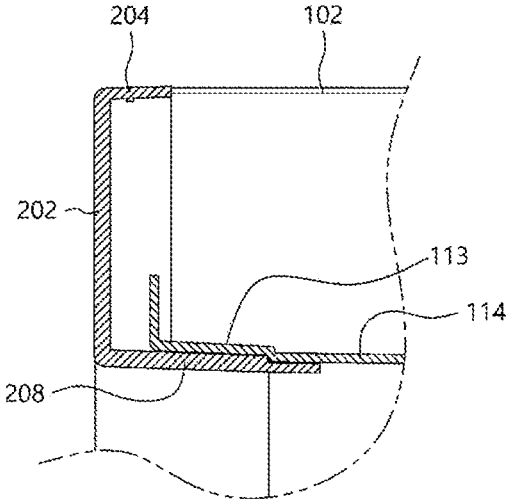
FIG. 23 is an enlarged cross-sectional view illustrating a state in which the storage chamber coupling end is inserted into the interior of the first storage chamber constituting the exemplary embodiment of the present disclosure.
Figure 24:
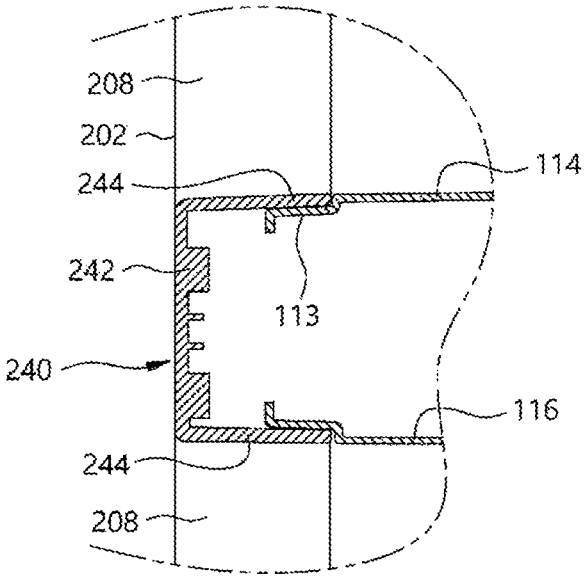
FIG. 24 is an enlarged cross-sectional view illustrating a state in which auxiliary coupling ends are inserted into the interiors of the first and second storage chambers constituting the exemplary embodiment of the present disclosure.
Figure 25:
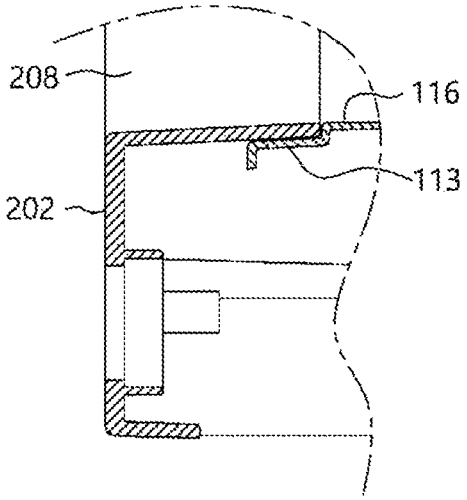
FIG. 25 is an enlarged cross-sectional view illustrating a state in which the storage chamber coupling end is inserted into the interior of the second storage chamber constituting the exemplary embodiment of the present disclosure.

FIG. 21 is an enlarged cross-sectional view illustrating a state in which the first storage chamber is coupled to the front frame part constituting the exemplary embodiment of the present disclosure. FIG. 22 is an enlarged cross-sectional view illustrating a state in which the second storage chamber is coupled to the front frame part constituting the exemplary embodiment of the present disclosure. FIG. 23 is an enlarged cross-sectional view illustrating a state in which the storage chamber coupling end is inserted into the interior of the first storage chamber constituting the exemplary embodiment of the present disclosure. FIG. 24 is an enlarged cross-sectional view illustrating a state in which auxiliary coupling ends are inserted into the interior of the first and second storage chambers constituting the exemplary embodiment of the present disclosure. FIG. 25 is an enlarged cross-sectional view illustrating a state in which the storage chamber coupling end is inserted into the interior of the second storage chamber constituting the exemplary embodiment of the present disclosure.

Next, referring to FIGS. 21 to 25, a structure in which the first and second inner casings 114 and 116 are coupled to the front frame part 200 of the refrigerator according to the exemplary embodiment of the present disclosure will be described in detail.

First, the first inner casing 114 is installed in an upper part of a rear surface side of the front frame part 200. The first inner casing 114 is formed in a chamber shape having an open front side, and the inner casing coupling end 208 of the front frame part 200 and the auxiliary coupling end 244 of the middle exterior frame 240 are inserted into the first inner casing 114 through the open part of the first storage chamber 114.

As shown in FIGS. 23 and 24, in a coupling region between the inner casing coupling end 208 and auxiliary coupling end 244 and the open side inner surface of the first storage chamber 114, the inner surface of the first inner casing 114 is inserted into the outer surfaces of the inner casing coupling end 208 and the auxiliary coupling end 244.

Among the outer surfaces of the inner casing coupling end 208 and the auxiliary coupling end 244, a region in which the inner surface of the first inner casing 114 is inserted is provided with an adhesive tape attached thereto. The first inner casing 114 may be temporarily fixed to the inner casing coupling end 208 and the auxiliary coupling end 244 by the adhesive tape (not shown) of the inner casing coupling end 208 and the auxiliary coupling end 244.

In addition, the second inner casing 116 is installed in the lower part of the rear surface side of the front frame part 200. The second inner casing 116 is formed in a chamber shape having an open front side, and the inner casing coupling end 208 of the front frame part 200 and the auxiliary coupling end 244 of the middle exterior frame 240 are inserted into the second inner casing 116 through the open part of the second storage chamber 116.

As shown in FIGS. 24 and 25, in a coupling region between the inner casing coupling end 208 and auxiliary coupling end 244 and the open side inner surface of the second storage chamber 116, the inner surface of the second inner casing 116 is inserted into the outer surfaces of the inner casing coupling end 208 and the auxiliary coupling end 244.

Among the outer surfaces of the inner casing coupling end 208 and the auxiliary coupling end 244, a region in which the inner surface of the second inner casing 116 is inserted is provided with an adhesive tape (not shown) attached thereto. The second inner casing 116 may be temporarily fixed to the inner casing coupling end 208 and the auxiliary coupling end 244 by the adhesive tape of the storage chamber coupling end 208.

In a state in which the first and second inner casings 114 and 116 are temporarily and respectively fixed on the upper and lower sides of a rear surface of the front frame part 200, the inside of the outer casing 100 is filled with a foam material, so that the first and second inner casings 114 and 116 may be firmly fixed to the inside of the outer casing 100.

As the front frame part 200 is installed on the front side of the outer casing 100 by the assembly structure of the front frame part 200 and the first and second inner casings 114 and 116 as described above, the front side edge parts of the first and second inner casings 114 and 116 are not exposed to the outside unlike the conventional refrigerator, whereby a beautiful appearance may be obtained on the front side of the refrigerator.

In addition, since the assembly process of the front frame part 200 and the first and second inner casings 114 and 116 may be easily performed by a simple operation of an operator, the assembly time and assembly workability of the refrigerator may be improved.

Figure 26:
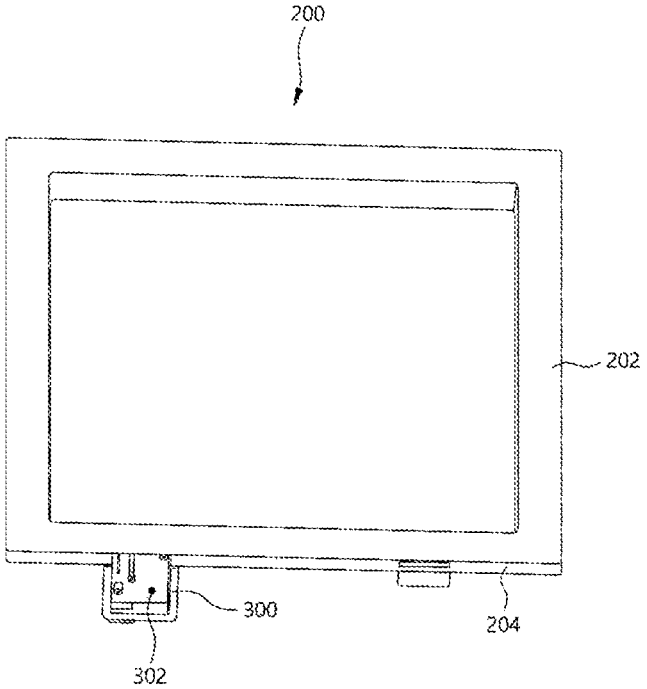
FIG. 26 is a perspective view illustrating a state in which a sensor module mounting part is formed on a lower part of the front frame part constituting the exemplary embodiment of the present disclosure.
Figure 27:
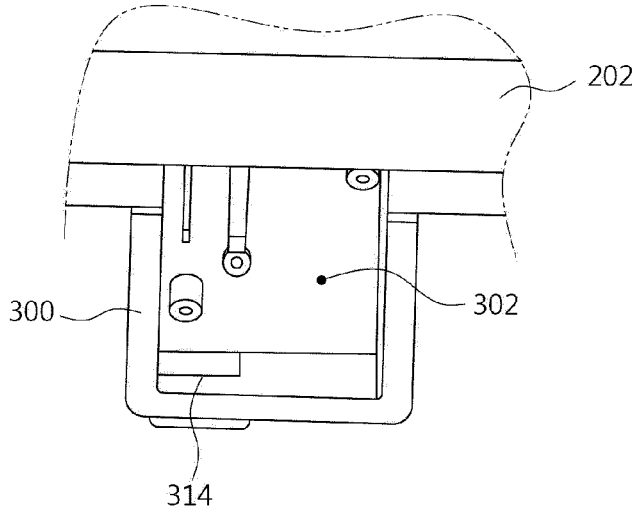
FIG. 27 is an enlarged perspective view illustrating a configuration of the sensor module mounting part constituting the exemplary embodiment of the present disclosure.
Figure 28:
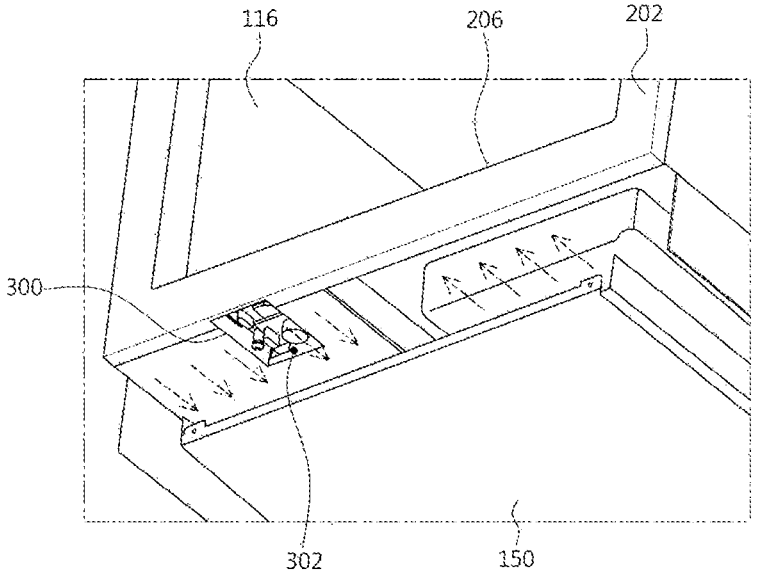
FIG. 28 is a bottom perspective view illustrating a state in which the sensor module mounting part is disposed inside a machine chamber constituting the exemplary embodiment of the present disclosure.
Figure 29:
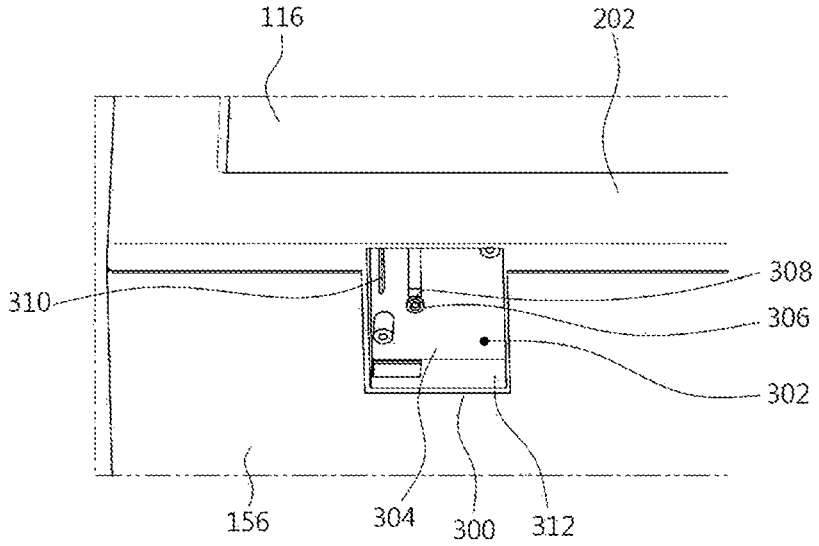
FIG. 29 is an enlarged view illustrating a state in which the sensor module mounting part is disposed inside the machine chamber constituting the exemplary embodiment of the present disclosure.
Figure 30:
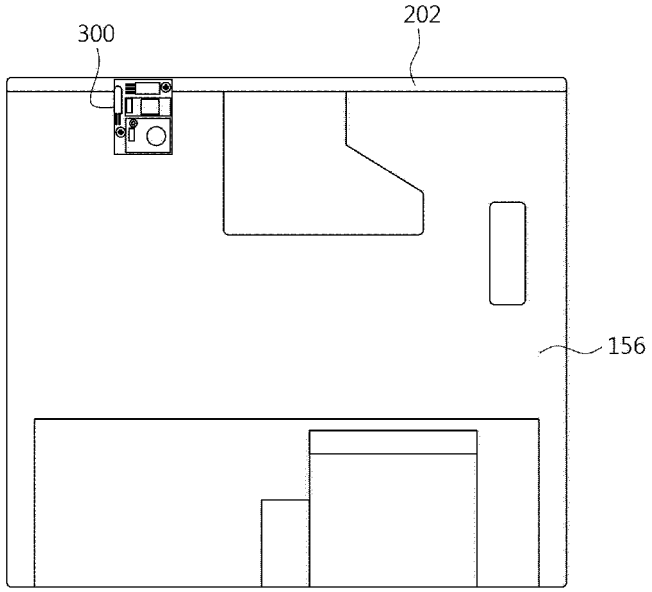
FIG. 30 is a bottom view illustrating a configuration of a ceiling part of the machine chamber constituting the exemplary embodiment of the present disclosure.
Figure 31:
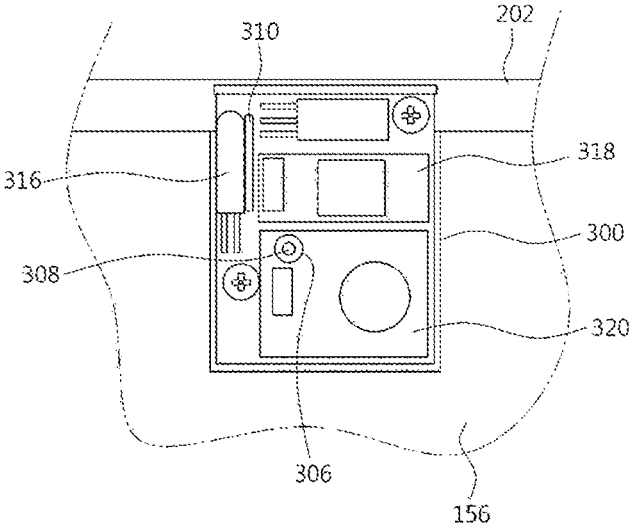
FIG. 31 is an enlarged bottom view illustrating the configuration of the sensor module mounting part constituting the exemplary embodiment of the present disclosure.
Figure 32:
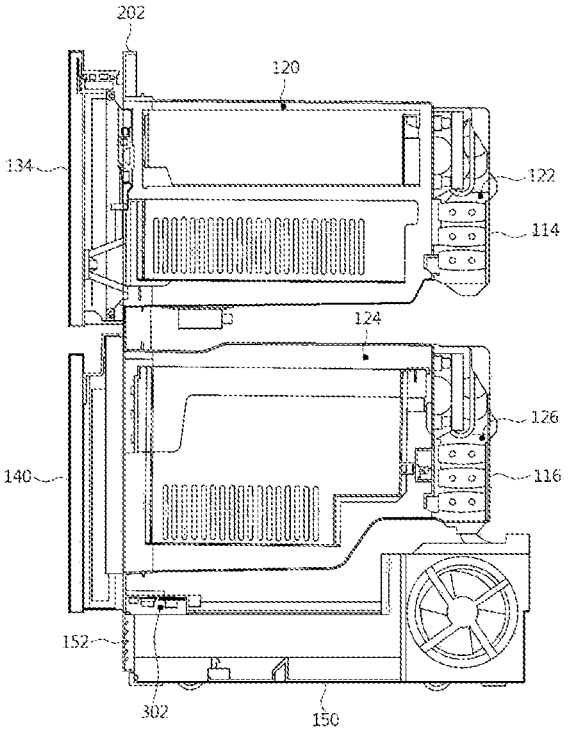
FIG. 32 is a cross-sectional view illustrating a state in which the sensor module mounting part is disposed in the front frame part constituting the exemplary embodiment of the present disclosure.
Figure 33:
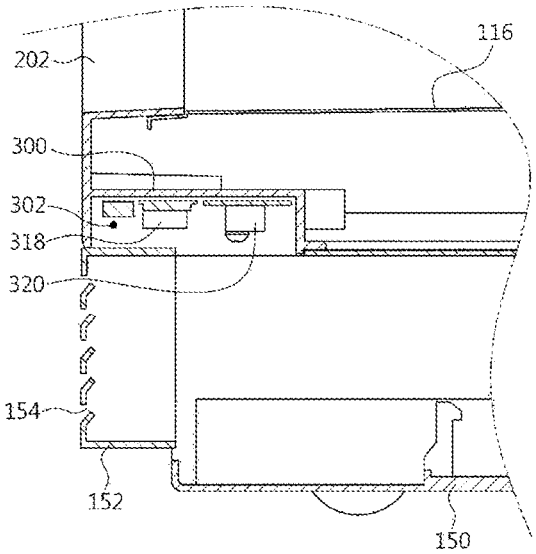
FIG. 33 is an enlarged cross-sectional view illustrating the configuration of the sensor module mounting part constituting the exemplary embodiment of the present disclosure.

FIG. 26 is a perspective view illustrating a state in which a sensor module mounting part is formed on the lower part of the front frame part constituting the exemplary embodiment of the present disclosure. FIG. 27 is an enlarged perspective view illustrating a configuration of the sensor module mounting part constituting the exemplary embodiment of the present disclosure. FIG. 28 is a bottom perspective view illustrating a state in which the sensor module mounting part is disposed inside a machine chamber constituting the exemplary embodiment of the present disclosure. FIG. 29 is an enlarged view illustrating a state in which the sensor module mounting part is disposed inside the machine chamber constituting the exemplary embodiment of the present disclosure. FIG. 30 is a bottom view illustrating a configuration of a ceiling part of the machine chamber constituting the exemplary embodiment of the present disclosure. FIG. 31 is an enlarged bottom view illustrating the configuration of the sensor module mounting part constituting the exemplary embodiment of the present disclosure. FIG. 32 is a cross-sectional view illustrating a state in which the sensor module mounting part is disposed in the front frame part constituting the exemplary embodiment of the present disclosure. FIG. 33 is an enlarged cross-sectional view illustrating the configuration of the sensor module mounting part constituting the exemplary embodiment of the present disclosure.

Next, a sensor module mounting part 300 of the refrigerator according to the exemplary embodiment of the present disclosure will be described in detail with reference to FIGS. 26 and 33.

The sensor module mounting part 300 is formed on a lower part of the rear surface of the front frame 202. The sensor module mounting part 300 is integrally formed with the front frame 202. The sensor module mounting part 300 is formed in a box shape having an open lower surface, and is formed to protrude rearward of the front frame 202.

A sensor module mounting space 302 is formed inside the sensor module mounting part 300, and is a part where various sensor modules to be described later are installed and fixed therein.

A sensor module fastening protrusion 306 is formed on an inner ceiling surface 304 of the sensor module mounting part 300. The sensor module fastening protrusion 306 is formed in a cylindrical shape, and is formed to protrude in a downward direction of the ceiling surface 304. A sensor module fixing screw hole 308 is formed in the center of a lower surface of the sensor module fastening protrusion 306. The formation positions and the number of formations of the sensor module fastening protrusions 306 may be changed according to the positions of various sensor modules installed in the sensor module mounting space 302.

The sensor module fastening protrusion 306 is a part where various sensor modules are screw-coupled thereto so that the various sensor modules are fixed to the sensor module mounting space 302.

A temperature sensor fixing rib 310 is formed on an inner ceiling surface 304 of the sensor module mounting part 300. The temperature sensor fixing rib 310 is formed in a rectangular plate shape, is disposed long forward and backward along the ceiling surface 304, and is formed to vertically protrude in a downward direction of the ceiling surface 304. The temperature sensor fixing rib 310 is disposed to be spaced apart from the inner side surface of the sensor module mounting part 300 by a predetermined distance. A temperature sensor module 316 to be described later is inserted and fixed to a position between the temperature sensor fixing rib 310 and the inner side surface of the sensor module mounting part 300.

A sensor module wiring hole 314 is formed on an inner rear surface 312 of the sensor module mounting part 300. The sensor module wiring hole 314 is formed in a square hole shape on a left side upper end of the inner rear surface of the sensor module mounting part 300, and is formed to pass through forward and backward. The sensor module wiring hole 314 is formed on the inner rear surface of the sensor module mounting part 300, and serves as a passage for guiding wiring of various sensor modules installed in the sensor module mounting space 302 to the outside of the sensor module mounting part 300.

Such a sensor module mounting part 300 is installed at a position on a front side of the ceiling part 156 of the machine chamber 150.

That is, the sensor module mounting part 300 may be installed at a position adjacent to an open part of the machine chamber 150.

That is, as various sensor modules to be described later are installed inside the sensor module mounting part 300 to detect an external environment of the refrigerator, it is preferable that the sensor module mounting part 300 is installed at a position adjacent to the outside of the refrigerator even inside the machine chamber.

In addition, an open part of the sensor module mounting part 300 is exposed to the outside through the ceiling part 156 of the machine chamber 150. As the open part of the sensor module mounting part 300 is exposed to the outside through the ceiling part 156 of the machine chamber 150, not only it is easy to attach and detach various sensor modules to be described later, but also it is possible for an operator to visually check whether there is a failure or not in the event of a probable failure.

In addition, it is preferable that the sensor module mounting part 300 is disposed on an inlet side of the machine chamber 150.

That is, as various sensor modules to be described later installed inside the sensor module mounting part 300 are mainly installed with sensor modules for detecting the external environment of the refrigerator, the changes in the external environment such as external temperature and external humidity of the refrigerator may be detected more quickly and accurately through the air flowing into the inlet of the machine chamber 150.

Various sensor modules are installed inside the sensor module mounting part 300. The various sensor modules to be installed may include a temperature sensor module 316, a humidity sensor module 318, and the like.

The various sensor modules to be installed may include various sensor modules in addition to the temperature sensor module 316 and the humidity sensor module 318, but only the temperature sensor module 316 and the humidity sensor module 318 will be described here.

The temperature sensor module 316 is installed inside the sensor module mounting part 300. The temperature sensor module 316 is a general temperature sensor and a detailed description thereof will be omitted. The temperature sensor module 316 is installed inside the sensor module mounting part 300 and serves to detect the external temperature of the refrigerator through the air flowing into the inlet side.

The humidity sensor module 318 is installed inside the sensor module mounting part 300. The humidity sensor module 318 is a general humidity sensor and a detailed description thereof will be omitted. The humidity sensor module 318 is installed inside the sensor module mounting part 300, and serves to detect the external humidity of the refrigerator through the air flowing into the inlet side.

Information of external temperature and external humidity of the refrigerator detected by the temperature sensor module 316 and the humidity sensor module 318 is transmitted to a controller to be utilized as data for control information of the refrigerator, or is displayed on a display (not shown) of the refrigerator, so as to enable a user to visually check the information of the external environment of the refrigerator.

In addition, other than the various sensor modules for detecting the external environment of the refrigerator, a wireless communication module 320 connected to the outside by wireless signals may be additionally installed in the sensor module mounting space 302.

As for the wireless communication module 320, various wireless communication modules capable of performing wireless communication such as Wi-Fi, Bluetooth, Zigbee, and the like may be installed, but the description herein is based on a Wi-Fi module.

The wireless communication module 320 is a general Wi-Fi module, and a detailed description thereof will be omitted. The wireless communication module 320 is installed inside the sensor module mounting space 302, and serves to connect an external smart device or an external wireless communication device to the refrigerator.

As described above, as the sensor module mounting part 300 is integrally formed on the front frame 202, the number of assembly parts of the refrigerator may be reduced, the assembly time of the refrigerator may be shortened, and the assembly man-hours may be reduced as well.

In addition, as the sensor module mounting part 300 is installed in a form that is open in the ceiling part 156 of the machine chamber 150, the sensor module mounting part 300 is exposed to the outside through the opening of the grill cover 152 of the machine chamber 150, whereby various sensor modules may be easily attached and detached, and states of the sensor modules may be visually checked in the event of a failure.

In addition, as the sensor module mounting part 300 is disposed on the inlet side even inside the machine chamber, the external temperature and humidity may be detected through the air flowing into the machine chamber from the outside, whereby changes in the external environment may be more quickly and accurately detected.

Figure 34:
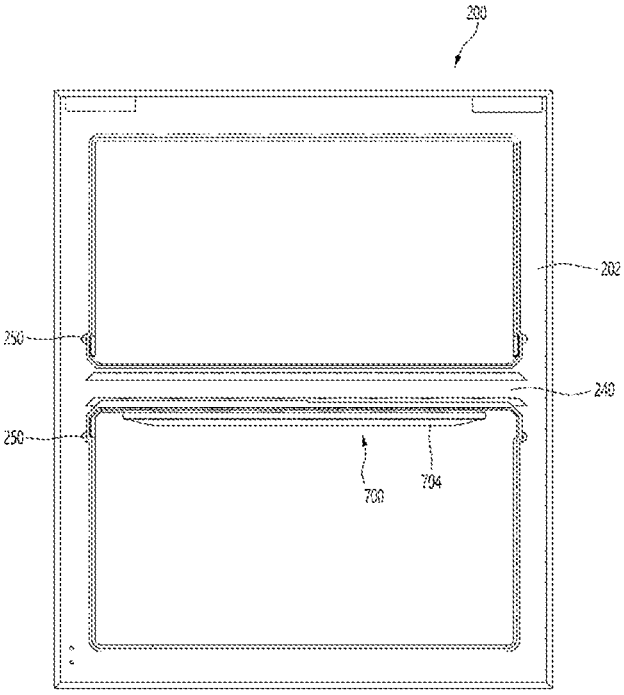
FIG. 34 is a front view illustrating a state in which a shielding member is installed in a front frame part constituting another exemplary embodiment of the present disclosure.
Figure 35:
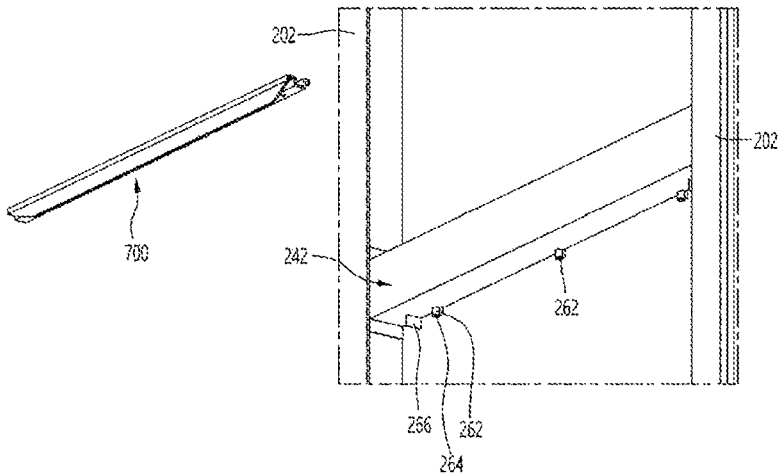
FIG. 35 is an exploded perspective view illustrating a state in which the shielding member is separated from the front frame part constituting another exemplary embodiment of the present disclosure.
Figure 36:
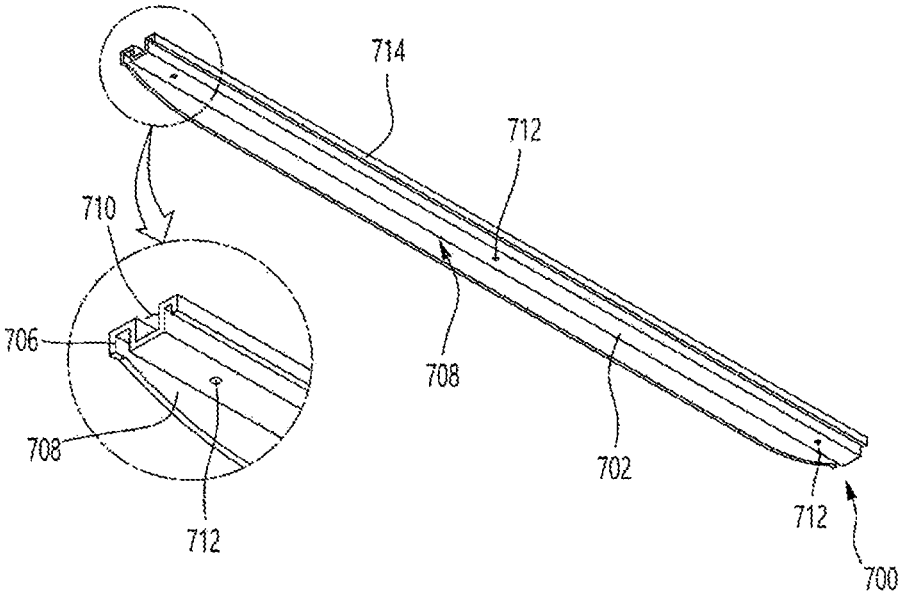
FIG. 36 is a front perspective view illustrating a configuration of the shielding member constituting the exemplary embodiment of the present disclosure.
Figure 37:
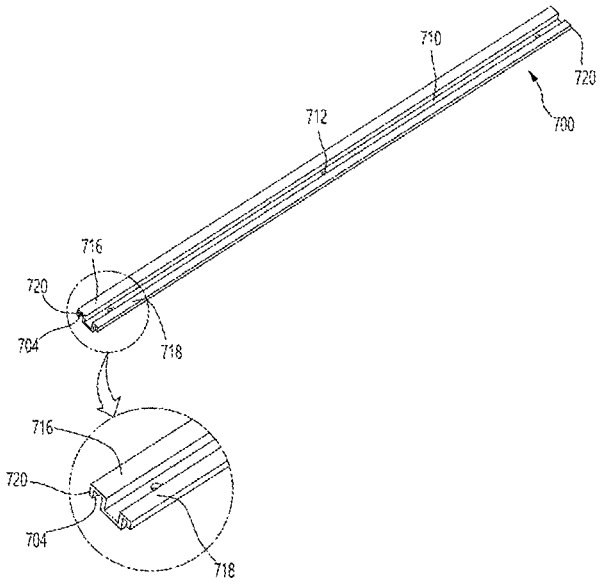
FIG. 37 is a rear perspective view illustrating the configuration of the shielding member constituting the exemplary embodiment of the present disclosure.
Figure 38:
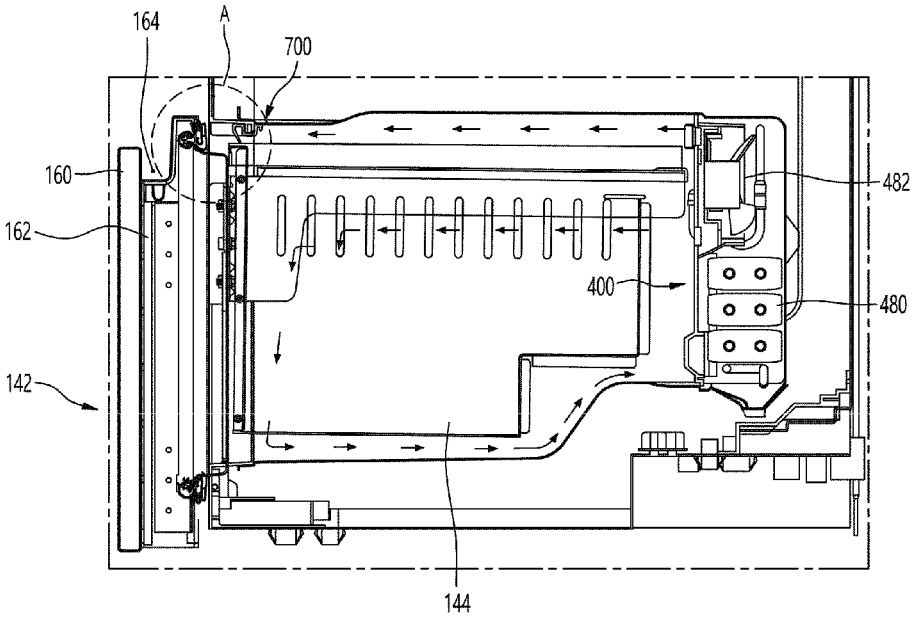
FIG. 38 is a cross-sectional view illustrating a state in which the shielding member constituting the exemplary embodiment of the present disclosure is mounted in the second storage chamber.
Figure 39:
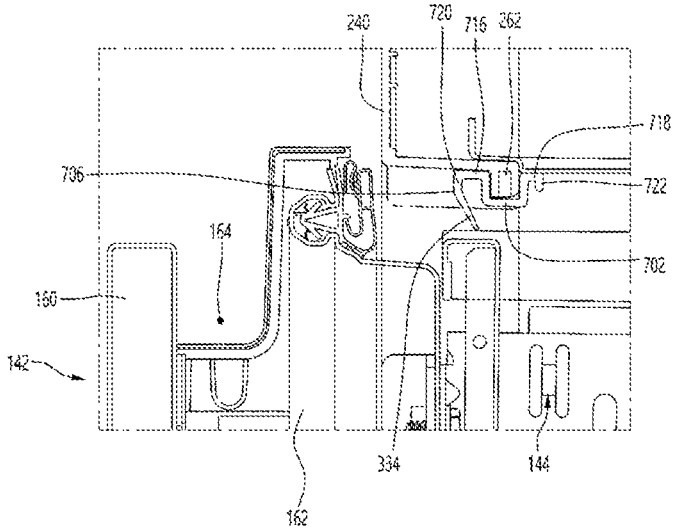
FIG. 39 is an enlarged view of part A of FIG. 38.

FIG. 34 is a front view illustrating a state in which a shielding member is installed in the front frame part constituting another exemplary embodiment of the present disclosure. FIG. 35 is an exploded perspective view illustrating a state in which the shielding member is separated from the front frame part constituting another exemplary embodiment of the present disclosure. FIG. 36 is a front perspective view illustrating a configuration of the shielding member constituting the exemplary embodiment of the present disclosure. FIG. 37 is a rear perspective view illustrating the configuration of the shielding member constituting the exemplary embodiment of the present disclosure. FIG. 38 is a cross-sectional view illustrating a state in which the shielding member constituting the exemplary embodiment of the present disclosure is mounted in the second storage chamber. FIG. 39 is an enlarged view of part A of FIG. 38.

Hereinafter, a front frame part and a shielding member according to another exemplary embodiment of the present disclosure will be described in detail with reference to FIGS. 34 and 39.

A shielding member fixing protrusion 262 to which a shielding member 700 to be described later is coupled may be formed on a lower surface of a front frame part 200.

A plurality of the shielding member fixing protrusions 262 may be formed on a center part and opposite sides of the lower surface of the middle exterior frame 240.

Each shielding member fixing protrusion 262 is formed in a cylindrical shape, and a shielding member fixing hole 264 may be formed in the center of a rear surface part of each shielding member fixing protrusion 262. A fastening screw (not shown) is coupled to the shielding member fixing protrusion 262 and shielding member fixing hole 264, so that the middle exterior frame 240 and the shielding member 700 may be firmly fixed.

In addition, the lower surface of the middle exterior frame 240 may include a fixing rib 266 for guiding a part on which the shielding member 700 is mounted when the shielding member 700 to be described later is mounted.

The fixing ribs 266 are formed in a plate shape, and may be formed to protrude from opposite sides of the lower surface of the middle exterior frame 240 in a downward direction. In the fixing ribs 266, when the shielding member 700 to be described later is mounted on the middle exterior frame 240, the opposite side ends of the shielding member 700 are allowed to be respectively inserted into and fixed to the fixing ribs 266, so that the shielding member 700 may be easily mounted thereto.

In addition, the shielding member fixing protrusions 262 and the fixing ribs 266 are preferably provided at the rear of the lower surface of the middle exterior frame 240. When the shielding member 700 to be described later is mounted on the middle exterior frame 240, a shielding member fixing part 702 of the shielding member 700 is positioned at the rear of the lower surface of the middle exterior frame 240, so that the shielding member 700, which will be described later, may be prevented from being exposed to the outside when the second door 142 is opened.

Next, a detailed configuration of the shielding member will be described in detail with reference to FIGS. 36 to 39.

As the shielding member 700 according to the exemplary embodiment of the present disclosure is mounted on an upper surface of the front side of the second inner casing 116 to block a space between the second inner casing 116 and the second door 142, the shielding member 700 serves to block the leakage of cold air of the second inner casing 116 to the outside.

The second door 142 is configured to include: a front panel 160 that forms a front exterior; a door panel 162 installed on a rear surface of the front panel 160 and filled with an insulating material; and the like.

The front panel 160 is formed with a plate having a predetermined thickness, and is installed on the front side of the second storage chamber 116. A variety of materials may be applied to the front panel 160. However, as the front panel 160 forms the exterior of the refrigerator, a stainless material may be applied for the beautiful appearance of the refrigerator.

The front panel 160 is disposed on the front side of the second storage chamber 116, and is a part that forms the appearance of the refrigerator.

The door panel 162 is installed on the rear surface of the front panel 160. The door panel 162 is formed in a plate shape having a cavity therein, and is formed horizontally long. The door panel 162 is manufactured through a sheet metal process in which a steel plate is bent multiple times.

The door panel 162 is installed on the rear surface of the front panel 160, and serves to close a front open part of the second storage chamber according to a user's operation.

In addition, a handle groove 164 is formed on an upper surface of the door panel 162. The handle groove 164 is formed horizontally long, and is recessed in a downward direction along the front side of the upper surface of the door panel 162. A lower surface of the handle groove 164 is recessed, so as to be positioned further lower than the upper surface of the front panel 160.

That is, the handle groove 164 may be formed to extend further downward than the upper surface of the second storage chamber 116.

User's fingers are received inside the handle groove 164, and an upper end part of the door panel 162 is gripped by a user, so that an operation of drawing-in and drawing-out of a second drawer part 126 may be performed.

That is, the upper end of the front surface of the door panel 162 of the second door 142 is positioned further downward than the upper end of the front panel 160, so as to provide a space between the rear surface of the front panel 160 and the lower door panel 162, thereby enabling the user to open and close the lower door 142 by putting his or her fingers in the space.

In particular, in the case of the second door 142, the handle groove 164 is provided on the upper surface of the door panel 162, so that the door panel 162 is formed to have a thickness thereof thinner at the upper part than the lower part. Accordingly, in the upper surface of the door panel 162, when the cold air circulating in the second inner casing 116 flows toward the rear surface of the second door 142, there is a problem in that dew condensation occurs on the front surfaces of the handle groove 164 and the like of the second door 142.

Accordingly, the shielding member 700 is provided between the rear surface of the second door 142 and the second drawer body 144, so as to block a flow of cold air circulating in the second inner casing 116 toward the upper end part of the second door 142, whereby it may be allowed to prevent dew condensation around the upper surface of the second door 142.

The shielding member 700 is provided on the front side of the upper surface of the second storage chamber 116, and extends downward from a position facing the handle groove 164, thereby serving to block the cold air flowing toward the handle groove 164.

In particular, the second drawer body 144 having an open upper surface thereof is inserted into the second storage chamber 116, so that cold air circulating in the upper part of the second drawer body 144 may flow to the rear surface of the second door 142 through a space between the upper end of the second drawer body 144 and the upper end of the second storage chamber 116.

The shielding member 700 is positioned further backward than the front surface of the second drawer body 144, so that the cold air flowing toward the rear surface of the second door 142 may be effectively blocked.

In addition, the shielding member 700 is preferably extended to the upper end of the second drawer body 144. That is, the present disclosure has a structure in which the shielding member may be connected from the upper end of the second drawer body 144 to the upper end of the second storage chamber 116. With such a structure, there is an advantage in that cold air flowing toward the upper side of the second drawer body 144 may be prevented from flowing toward the rear surface side of the second door 142.

The shielding member 700 is preferably formed to extend to a position lower than the upper end of the second door 142 and higher than the upper end of the front surface of the second drawer body 144.

In addition, the shielding member 700 may be mounted at an upper position of the front surface of the second drawer body 144. That is, by providing the shielding member 700 on the rear side of the lower surface of the middle exterior frame 240, cold air may be effectively blocked while minimizing external exposure.

The shielding member 700 may be configured to include: a shielding member fixing part 702 fixed to an upper side of the second storage chamber 116; and a shielding part 704 configured to extend downward from a front end of the shielding member fixing part 702.

The shielding member fixing part 702 is formed in a rectangular frame shape having an open upper side, and may be formed horizontally long. In detail, the shielding member fixing part 702 may include a recessed part 710 formed to be recessed downward along an extension direction of the shielding member fixing part 702 and to which the shielding member fixing protrusion 262 is inserted.

Fixing protrusion coupling holes 712 configured to pass through upward and downward are formed in the recessed part 710 of the shielding member fixing part 702. The fixing protrusion coupling holes 712 may be formed to pass through upward and downward at predetermined intervals along the lower surface of the shielding member fixing part 702. Fastening screws (not shown) respectively pass through the fixing protrusion coupling holes 712, so that the shielding member fixing part 702 may be firmly fixed to the shielding member fixing protrusion 262.

The shielding member fixing part 702 may be formed by bending in the upward and downward direction multiple times. The shielding member 700 may be formed of a flexible plastic material, and is formed by bending the shielding member fixing part 702 multiple times, whereby the shape of the shielding member 700 may be firmly maintained.

The shielding member fixing part 702 may be installed at a position corresponding to the rear end of the middle external frame 240. The shielding member 700 is mounted on the rear end side of the middle exterior frame 240, so as to be mounted at a position adjacent to the second inner casing 116 as much as possible. The reason is to prevent the shielding member 700 from being exposed to the outside when a user opens the second door 142.

In addition, the fixing ribs 266 of the middle external frame 240 are respectively inserted into opposite ends of the shielding member fixing part 702, so that the inside of the shielding member fixing part 702 may be sealed. Accordingly, the cold air circulating in the second inner casing 116 may be more effectively blocked from flowing toward the upper end side of the lower door 142.

The shielding part 704 is formed in the front of the shielding member fixing part 702. The shielding part 704 may be formed horizontally long along the front surface of the shielding member fixing part 702 and inclined downward toward the second inner casing 116 side.

The shielding part 704 may be configured to include: a vertical part 706 that extends downward from a front end of the shielding member fixing part 702; and an inclined part 708 in which the more it extends from a lower end of the vertical part 706, the more it faces rearward.

The vertical part 706 may extend to a lower end of the recessed part 710. The vertical part 706 may more firmly support the inclined part 708 of the shielding part 704, and may restrict the shielding part 704 to move only within a lower part of the shielding member fixing part 702.

The inclined part 708 may be formed to be inclined toward the second inner casing 116 as it extends downward. That is, the inclined part 708 is inclined toward the rear side of the second door 142, so that exposure of the shielding member 300 to the outside may be minimized when a user opens the second door 142.

In addition, the inclined part 708 may be formed to be gradually thinner toward the end thereof. The shielding part 704 is positioned on the rear surface of the upper end of the second door 142, and serves to prevent cold air of the second inner casing 116 from circulating to the upper end part of the second door 142.

In addition, as the inclined part 708 is formed to have a thickness gradually thinner toward the end thereof, a region in contact with the rear surface side of the second door 142 is in close contact with an end part of the shielding part 704 gently, whereby damage to the second door 142 due to the contact of the shielding part 704 may be minimized.

In addition, the more the inclined part 708 goes downward, the shorter the inclined part 708 may be formed in length in the left and right direction. In a state of being mounted on the middle external frame 240, the shielding part 704 is formed to be inclined toward the second storage chamber 116, as the shielding part 704 goes toward the lower end thereof. In this case, the reason is to prevent the shielding part 704 from moving significantly due to the opening and closing of the second door 142, and to prevent the shielding part 704 from being obstructed when the second door 142 is opened and closed.

In addition, the extension parts 714 may be respectively formed on the front and rear of the upper side of the shielding member fixing part 702. That is, one end of the extension part 714 may be connected to one end of the shielding member fixing part 702, and the other end of the extension part 714 may be connected to one end of the shielding part 704.

The extension part 714 may be configured to include: a front side extension part 716 formed to protrude forward from along a front side edge part of an upper part of the shielding member fixing part 702; and a rear side extension part 718 formed to protrude rearward from along a rear side edge part of the upper part of the shielding member fixing part 702.

Accordingly, the front side extension part 716 is formed to be in close contact with the lower surface of the middle exterior frame 240, and the rear side extension part 718 is formed to be in close contact with the inner surface of the second storage chamber 116.

The extension part 714 is in close contact with the lower surface of the middle exterior frame 240, so as to allow the shielding member 700 to be more firmly fixed to the middle exterior frame 240.

In addition, one end of the front side extension part 716 is connected to the shielding member fixing part 702, and the other end of the front side extension part 716 is connected to the shielding part 704 to be described later, thereby serving to support the shielding part 704.

The front side extension part 716 may further include a front side extension surface 720 configured to have a front end thereof bent and extended in a downward direction. In addition, the rear side extension part 718 may further include a rear side extension surface 722 configured to have a rear end thereof bent and extended in the downward direction. The front side and rear side extension surfaces 720 and 722 may more increase the strength of the shielding member 700. The front side extension surface 720 may be connected to the vertical part 706 of the shielding part 704.

In the refrigerator according to the present disclosure, cold air generated through heat exchange of an evaporator 480 provided at the rear of the storage space may be introduced into the storage space through a discharging hole of a grill fan 400. In this case, the cold air flows from the rear to the front along the upper side of the second storage chamber 116, and the cold air flowing from the upper side of the second drawer body 144 moves downward by the shielding member 700. Accordingly, by blocking the cold air from flowing toward the rear surface side of the second door 142 by the shielding member 700, dew condensation may be prevented from occurring on the upper part of the second door 142.

Hereinafter, a preferred exemplary embodiment of a wine refrigerator according to the present disclosure will be described in detail with reference to the accompanying drawings.

Figure 40:
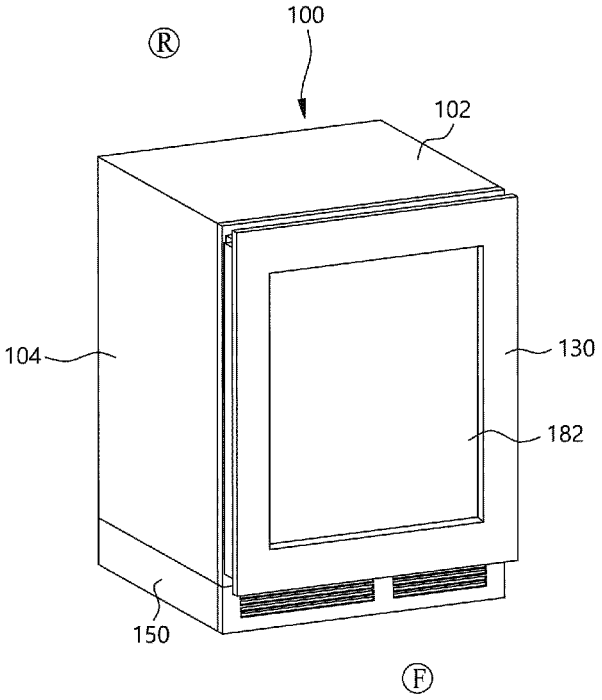
FIG. 40 is a perspective view illustrating a configuration of a preferred exemplary embodiment of a wine refrigerator according to the present disclosure.
Figure 41:
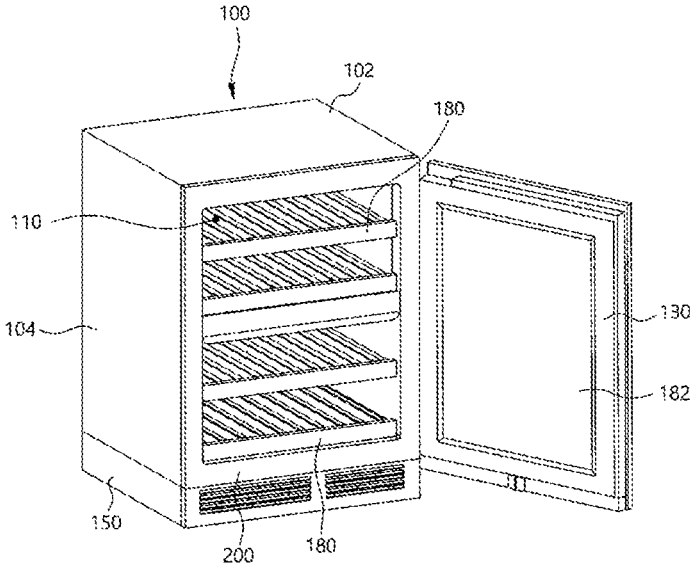
FIG. 41 is a perspective view illustrating an open state of a door of the wine refrigerator constituting the exemplary embodiment of the present disclosure.
Figure 42:
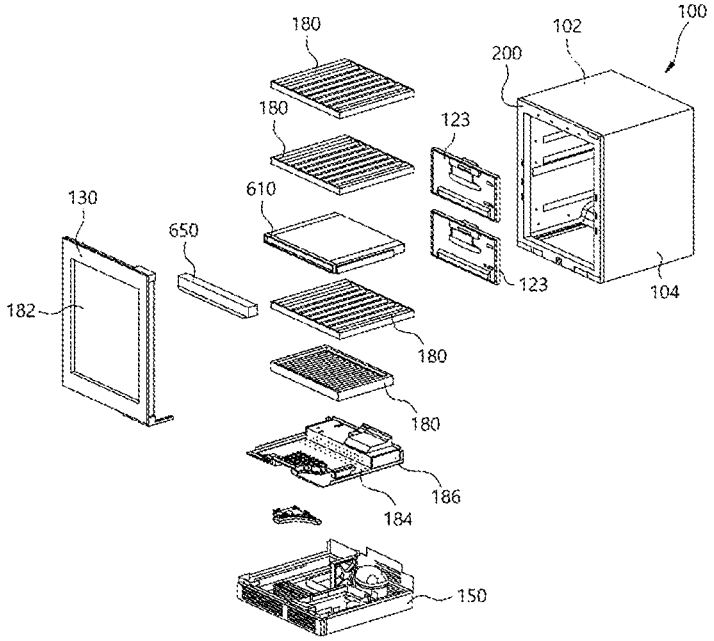
FIG. 42 is an exploded perspective view illustrating the configuration of the preferred exemplary embodiment of the wine refrigerator according to the present disclosure.

FIG. 40 is a perspective view illustrating a configuration of a preferred exemplary embodiment of a wine refrigerator according to the present disclosure. FIG. 41 is a perspective view illustrating an open state of a door of the wine refrigerator constituting the exemplary embodiment of the present disclosure. FIG. 42 is an exploded perspective view illustrating the configuration of the preferred exemplary embodiment of the wine refrigerator according to the present disclosure.

The refrigerator of the present disclosure is largely configured to include: an outer casing 100, an inner casing 112, a barrier module 600, a door 130, a front frame part 200, a shelf 180, and a machine chamber 150. Among those parts, the shelf 180 and the barrier module 600 are installed inside the inner casing 112, and the door 130 is assembled on a front surface of the outer casing 100. In addition, the machine chamber 150 is assembled to a lower part of the outer casing 100.

Referring to FIG. 40, the outer casing 100 forms the exterior of the refrigerator, and as shown, the overall height of the outer casing 100 is made low. The refrigerator of the present exemplary embodiment is a built-in type refrigerator installed inside an island table, etc., and has a lower height than that of a general refrigerator. Accordingly, not only the internal capacity is low, but also a space in which each part may be installed is formed small. Accordingly, it is necessary to effectively dispose the parts in order to utilize the small and low installation space. To this end, in the present exemplary embodiment, an operation panel part 650 is installed inside the inner casing 112.

In addition, unlike the conventional refrigerator, the refrigerator of the present disclosure has a structure in which the outer casing 100 and the inner casing 112 are installed on the rear surface side of the front frame part 200, thereby allowing a beautiful appearance to be formed on the front side of the outer casing 100. Such a structure will be described below.

First, the outer casing 100 of the refrigerator according to the exemplary embodiment of the present disclosure will be described.

The outer casing 100 is a part that forms the exterior of the refrigerator.

Such an outer casing 100 is configured to include an upper side part 102 that forms an upper side wall, two side wall parts 104 that form opposite side walls, and a rear wall 106 that forms a rear side wall.

In addition, the outer casing 100 is composed of a box body having an open front surface and an open lower surface. In this case, an inner space of the outer casing 100 is provided as a storage space 110.

An inner casing 112 is installed inside the storage space 110 of the outer casing 100. The inner casing 112 is formed in a chamber shape having an open front side, and is installed inside the storage space 110. The interior of the inner casing 112 is apart in which food and food containers are stored and kept.

A coupling part 113 is formed on a front edge part of the inner casing 112. The coupling part 113 is formed to extend from along the open front edge part of the inner casing 112 in an outward direction. The inner part of the coupling part 113 is a part to which a storage chamber coupling end 208, which will be described later, is inserted and fixed.

A barrier module 600, which will be described later, is installed inside the inner casing 112, thereby dividing the inner casing 112 into a first inner casing 114 and a second storage chamber 116.

That is, the barrier module 600, which will be described later, is installed inside the inner casing 112, thereby respectively dividing upper and lower sides of the inner casing 112 into the first inner casing 114 and the second storage chamber 116.

Grill plates 123 are respectively installed inside the first inner casing 114 and the second storage chamber 116. As shown in FIG. 42, the grill plates 123 are formed in a flat plate shape, are respectively installed inside the first and second inner casings 114 and 116, and serve to divide interiors of the first and second inner casings 114 and 116 into cold air circulation spaces 120 and cold air generation spaces 122. (See FIG. 46)

By the grill plates 123, the front inner spaces of the first and second inner casings 114 and 116 are divided into the cold air circulation spaces 120, and the rear inner spaces of the first and second inner casings 114 and 116 are divided into the cold air generation spaces 122.

A plurality of shelves 180 is installed inside the first and second inner casings 114 and 116. Each shelf is a general shelf and a detailed description thereof will be omitted. Guide rails (not shown) are respectively installed on opposite side surfaces of each shelf 180, so that each shelf 180 is able to be drawn out to the outside of the first and second inner casings 114 and 116. Food and food containers, and various refrigerated and frozen foods such alcoholic beverages and drinks may be stored on the upper surface of each shelf 180.

A door 130 is installed on a front side of the outer casing 100. Such a door 130 is for opening and closing the first and second inner casings 114 and 116 of the outer casing 100, and the door 130 has a structure in which the door is opened and closed through rotation. More precisely, the door 130 is in close contact with the front frame part 200 to be described later to shield the front side open parts of the first and second inner casings 114 and 116, or the door 130 moves away from the front frame part 200 to be described later through rotation to open the front side open parts of the first and second inner casings 114 and 116.

In addition, at least a part of the door 130 is formed in a structure of a transparent see-through window 182, so that the inside of the first and second inner casings 114 and 116 may be checked from the outside.

In this case, the see-through window 182 is preferably formed of a material capable of seeing through the interior, and may be formed of glass as an example. When the see-through window 182 is formed of glass, a protective film (not shown) may be attached to the glass. Preferably, such a protective film is made of a light blocking (i.e. partial blocking) film that minimizes light of transmitting and illuminating the interior of the first and second inner casings 114 and 116. Naturally, it may be configured such that the see-through window 182 itself is formed to have a dark color instead of using the protective film, so as to minimize the transmission of light in the storage chamber.

Next, the machine chamber 150 is installed in a lower part of the outer casing 100. The machine chamber 150 is configured to provide a lower structure of the refrigerator. Various air conditioning devices (i.e. a condenser, a blower fan, a compressor, etc.) may be installed inside the machine chamber 150, but detailed description will be omitted herein.

Figure 43:
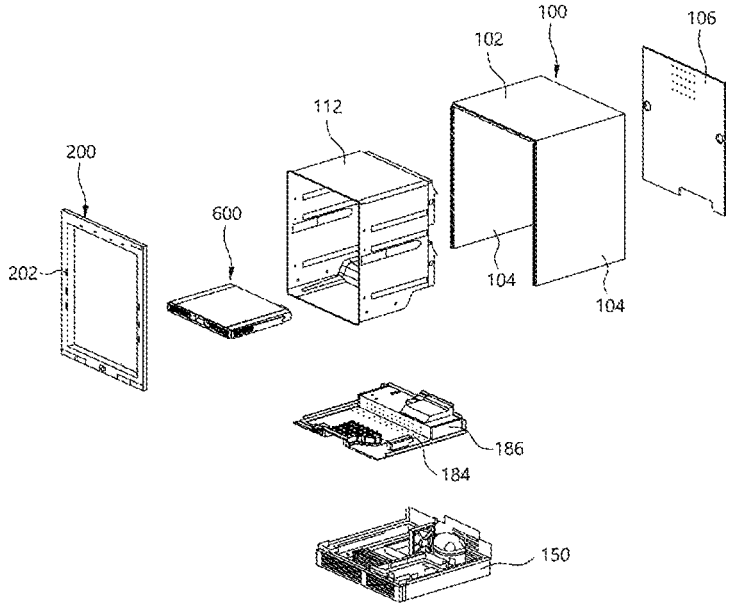
FIG. 43 is an exploded perspective view illustrating a state in which the front frame part, an inner casing, the barrier module, the outer casing, the rear wall, and the machine chamber constituting the exemplary embodiment of the present disclosure are separated.

As shown in FIGS. 42 and 43, the machine chamber 150 is installed in the lower part of the outer casing 100, and has a substantially rectangular shape as shown in FIG. 42. The machine chamber 150 has an open upper part thereof, and at least a part of an air conditioner may be installed therein.

A cover plate 184 is installed between the outer casing 100 and the machine chamber 150. The cover plate 184 has a flat plate shape and closes an upper surface of the machine chamber 150. A protrusion part 186 corresponding to the height of the air conditioner installed in the machine chamber 150 is provided on a rear side of the upper surface of the cover plate 184.

As such, the cover plate 184 is installed in an upper side open part of the machine chamber 150, and serves to close the upper side opening part of the machine chamber 150.

Figure 44:
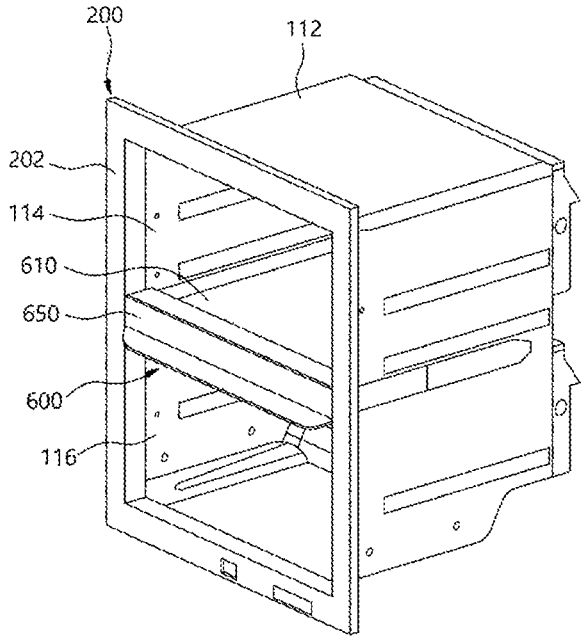
FIG. 44 is a perspective view illustrating a state in which the inner casing and the barrier module are mounted on the front frame part constituting the exemplary embodiment of the present disclosure.
Figure 45:
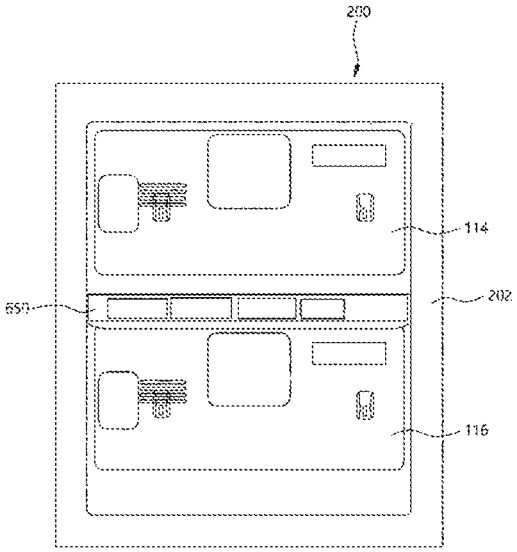
FIG. 45 is a front view illustrating a state in which the inner casing and the barrier module are mounted on the front frame part constituting the exemplary embodiment of the present disclosure.
Figure 46:
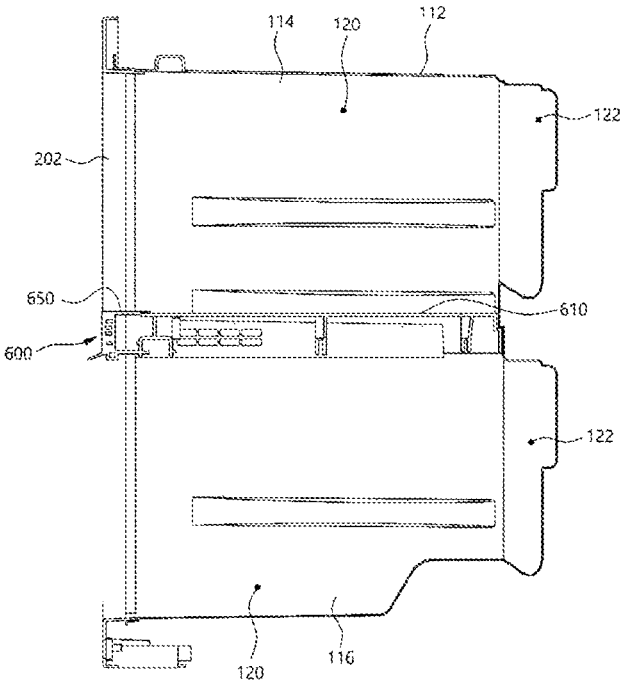
FIG. 46 is a cross-sectional view illustrating a state in which the inner casing and the barrier module are mounted on the front frame part constituting the exemplary embodiment of the present disclosure.
Figure 47:
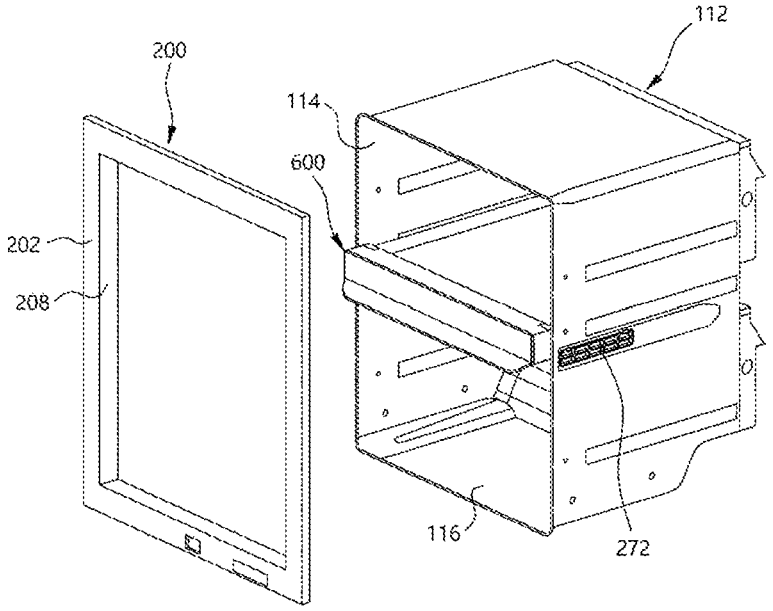
FIG. 47 is a perspective view illustrating a state in which the front frame part constituting the exemplary embodiment of the present disclosure is separated from the inner casing and the barrier module.
Figure 48:
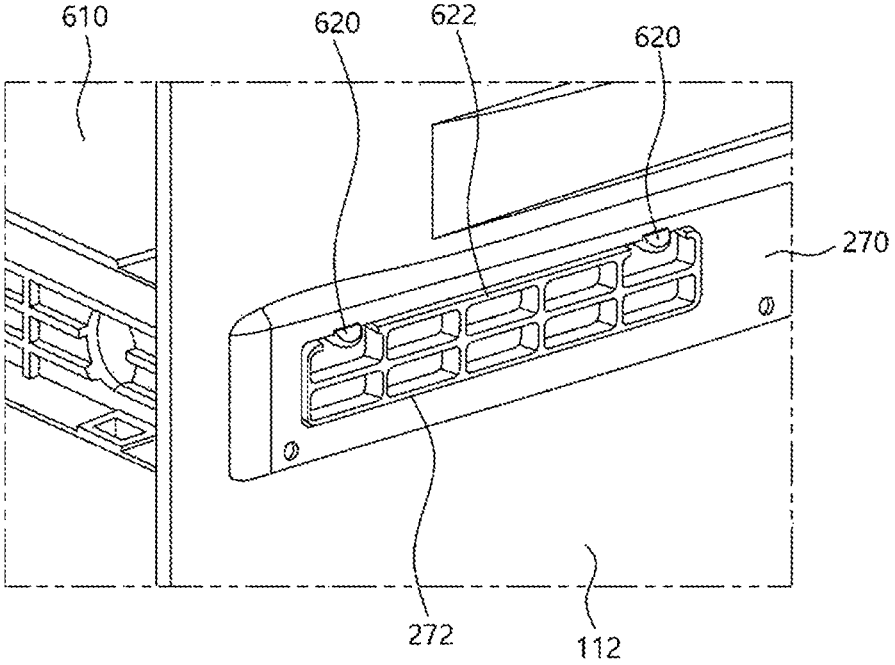
FIG. 48 is an enlarged view illustrating a state in which the barrier module is mounted in a barrier mounting groove of the inner casing constituting the exemplary embodiment of the present disclosure.
Figure 49:
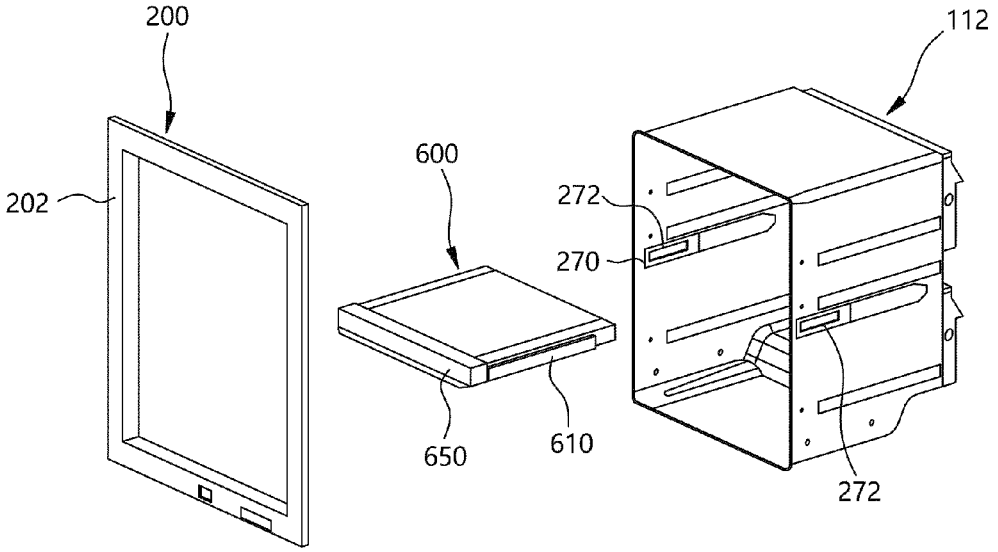
FIG. 49 is a front exploded perspective view illustrating a state in which the front frame part, the barrier module, and the inner casing constituting the exemplary embodiment of the present disclosure are separated.
Figure 50:
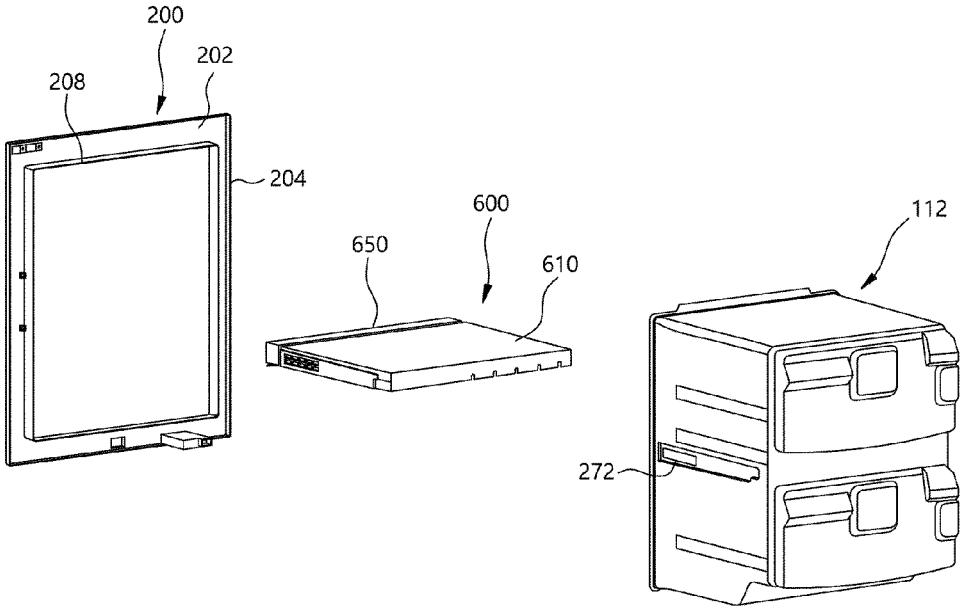
FIG. 50 is a rear exploded perspective view illustrating a state in which the front frame part, the barrier module, and the inner casing constituting the exemplary embodiment of the present disclosure are separated.
Figure 51:
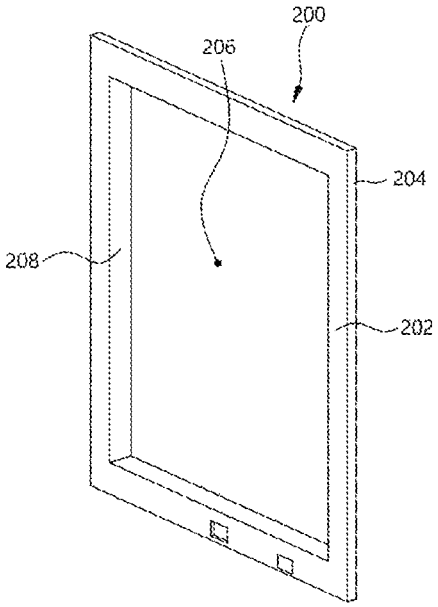
FIG. 51 is a front perspective view illustrating the configuration of the front frame part constituting the exemplary embodiment of the present disclosure.
Figure 52:
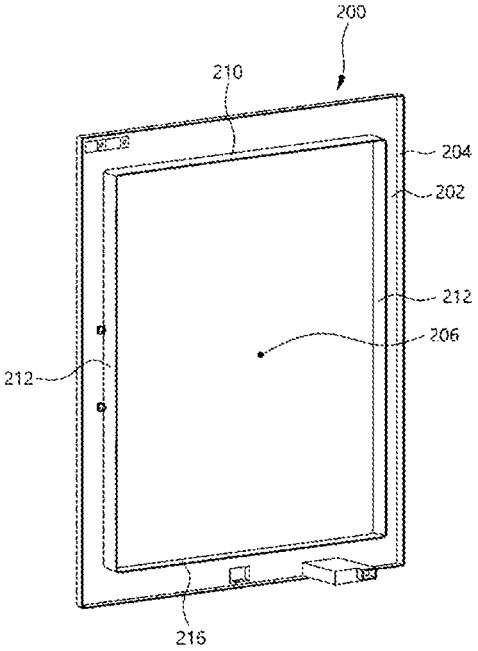
FIG. 52 is a rear perspective view illustrating the configuration of the front frame part constituting the exemplary embodiment of the present disclosure.
Figure 53:
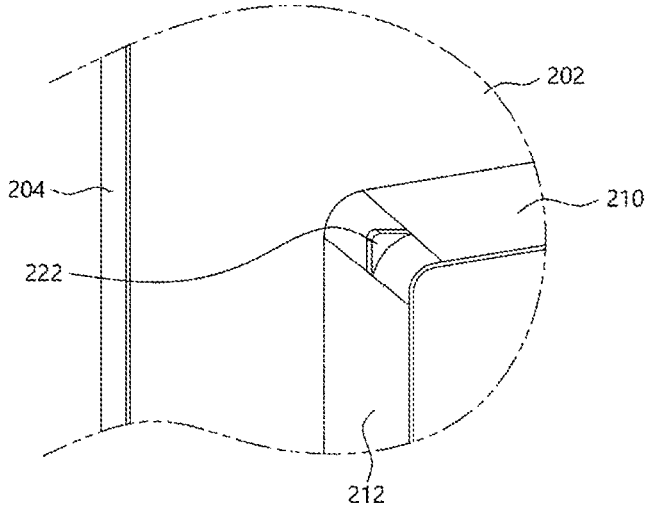
FIG. 53 is an enlarged perspective view illustrating a configuration of a corner part adjustment jaw constituting the exemplary embodiment of the present disclosure.
Figure 54:
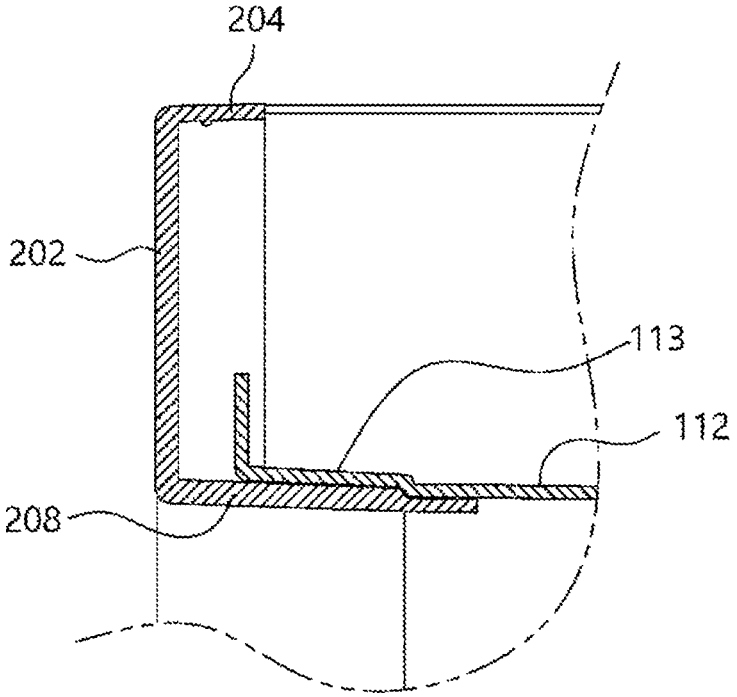
FIG. 54 is an enlarged cross-sectional view illustrating a state in which the storage chamber coupling end positioned on an upper side of the front frame part is inserted into the inner casing constituting the exemplary embodiment of the present disclosure.
Figure 55:
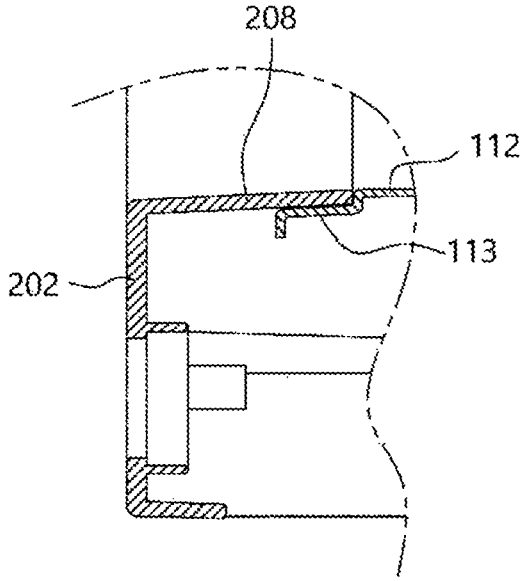
FIG. 55 is an enlarged cross-sectional view illustrating a state in which the storage chamber coupling end positioned at a lower side of the front frame part is inserted into the inner casing constituting the exemplary embodiment of the present disclosure.

FIG. 43 is an exploded perspective view illustrating a state in which the front frame part, the inner casing, the barrier module, the outer casing, the rear wall, and the machine chamber constituting the exemplary embodiment of the present disclosure are separated. FIG. 44 is a perspective view illustrating a state in which the inner casing and the barrier module are mounted on the front frame part constituting the exemplary embodiment of the present disclosure. FIG. 45 is a front view illustrating a state in which the inner casing and the barrier module are mounted on the front frame part constituting the exemplary embodiment of the present disclosure. FIG. 46 is a cross-sectional view illustrating a state in which the inner casing and the barrier module are mounted on the front frame part constituting the exemplary embodiment of the present disclosure. FIG. 47 is a perspective view illustrating a state in which the front frame part constituting the exemplary embodiment of the present disclosure is separated from the inner casing and the barrier module. FIG. 48 is an enlarged view illustrating a state in which the barrier module is mounted in a barrier mounting groove of the inner casing constituting the exemplary embodiment of the present disclosure. FIG. 49 is a front exploded perspective view illustrating a state in which the front frame part, the barrier module, and the inner casing constituting the exemplary embodiment of the present disclosure are separated. FIG. 50 is a rear exploded perspective view illustrating a state in which the front frame part, the barrier module, and the inner casing constituting the exemplary embodiment of the present disclosure are separated. FIG. 51 is a front perspective view illustrating the configuration of the front frame part constituting the exemplary embodiment of the present disclosure. FIG. 52 is a rear perspective view illustrating the configuration of the front frame part constituting the exemplary embodiment of the present disclosure. FIG. 53 is an enlarged perspective view illustrating a configuration of a corner part adjustment jaw constituting the exemplary embodiment of the present disclosure. FIG. 54 is an enlarged cross-sectional view illustrating a state in which the storage chamber coupling end positioned on the upper side of the front frame part is inserted into the inner casing constituting the exemplary embodiment of the present disclosure. FIG. 55 is an enlarged cross-sectional view illustrating a state in which the storage chamber coupling end positioned at a lower side of the front frame part is inserted into the inner casing constituting the exemplary embodiment of the present disclosure.

Referring to FIGS. 43 to 55, the front frame part 200 of the refrigerator according to the exemplary embodiment of the present disclosure will be described in detail The front frame part 200 is configured to include: a front frame 202 formed in a square frame shape and installed on a front side of an outer casing 100 to form a front side exterior of the outer casing 100; an opening part 206 formed to pass through forward and backward in a front side of a front frame 202, and configured to communicate with an open part of an inner casing 112; an inner casing coupling end 208 formed to protrude rearward from along an inner side edge part of the opening part 206, and inserted into an inner surface of the inner casing 112; and the like.

As shown in FIG. 51, the front frame 202 is formed with a rectangular frame having a predetermined thickness, and is installed on the front side of the outer casing 100. The front frame 202 is a part installed on the front side of the outer casing 100 to form a front side exterior of the outer casing 100.

An outer casing coupling end 204 is formed on an outer edge part of the front frame 202. As shown in FIG. 52, the outer casing coupling end 204 is formed to protrude rearward by a predetermined length from along an outer edge part of the front frame 202. The outer casing coupling end 204 is a part formed to protrude rearward from each of the upper, lower, left, and right ends of the front frame 202 to couple to the front edge part of the outer casing 100.

An opening part 206 is formed in a front side of the front frame 202. The opening part 206 is formed in a rectangular shape and formed to pass through forward and backward in the front side of the front frame 202. The opening part 206 is a part formed to pass through forward and backward in the front frame 202 to allow a plurality of shelves 180 installed inside the first and second inner casings 114 and 116 to be made to slide horizontally in and out.

The inner casing coupling end 208 is formed on the inner side edge part of the opening part 206. The inner casing coupling end 208 is configured to include: a first edge end 210 formed horizontally long along an upper side edge part of the opening part 206, and configured to protrude by a predetermined length rearward of the front frame 202; second edge ends 212 formed vertically long along left and right side edge parts of the opening part 206, and configured to protrude by a predetermined length to a rear side of the front frame 202; and a third edge end 216 formed horizontally long along a lower side edge part of the opening part 206, and configured to protrude by a predetermined length to the rear side of the front frame 202.

The first edge end 210 is formed to protrude rearward from along the upper side edge part of the opening part 206 of the front frame 202. The first edge end 210 is a part inserted into the front side of the inner upper surface. (See FIG. 54)

That is, an outer surface of the first edge end 210 is inserted into the inner surface of the inner casing 112 through the open part of the inner casing 112, so that the inner casing 112 is fixed to the front frame 202.

The second edge ends 212 are respectively formed on opposite sides of the first edge end 210. The second edge ends 212 are formed to respectively protrude rearward from along the left and right side edge parts of the opening part 206 of the front frame 202. The second edge ends 212 are inserted into the opposite side surfaces of the interior of the inner casing 112, and serve to fix the inner casing 112 to the front frame 202.

The third edge end 216 is formed at the lower parts of the second edge ends 212. The third edge end 216 is formed to protrude rearward from along the lower side edge part of the opening part 206 of the front frame 202. The third edge end 216 is inserted into inner lower surface of the inner casing 112, and serves to fix the inner casing 112 to the front frame 202. (See FIG. 55)

Due to the structure of the front frame part 200 as described above, the inner casing coupling end 208 is inserted into the inner casing 112 through the open part of the inner casing 112, whereby the assembly of the front frame part 200 and the inner casing 112 may be easily performed by a simple operation of an operator.

Hereinafter, referring to FIG. 53, a corner part adjustment jaw 222 according to the exemplary embodiment of the present disclosure will be described in detail.

Each corner part of the inner casing coupling end 208 is formed with a corner part adjustment jaw 222. The corner part adjustment jaw 222 is formed with a triangular plate, and is formed to protrude from each corner part of the inner casing coupling end 208 in a diagonal direction. When the inner surface of the inner casing 112 is inserted into the outer surface of the storage chamber coupling end 208, each corner part adjustment jaw 222 serves as a locking jaw preventing the inner surface of the inner casing 112 from being inserted more than a predetermined depth.

That is, as each corner part adjustment jaw 222 is formed on an outer peripheral surface of the storage chamber coupling end 208, the inner casing coupling end 208 may be prevented from being inserted into the inner casing 112 more than a predetermined depth.

Figure 56:
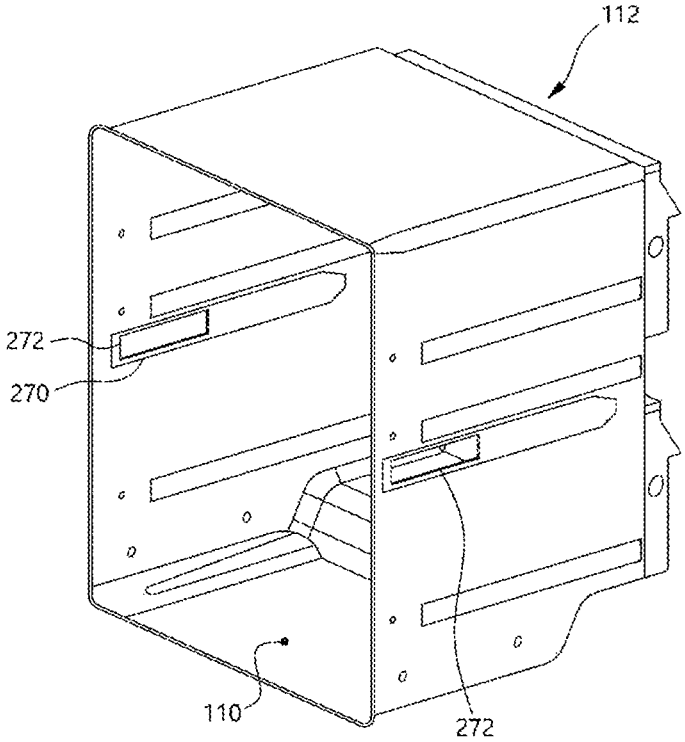
FIG. 56 is a front perspective view illustrating a configuration of the inner casing constituting the exemplary embodiment of the present disclosure.
Figure 57:
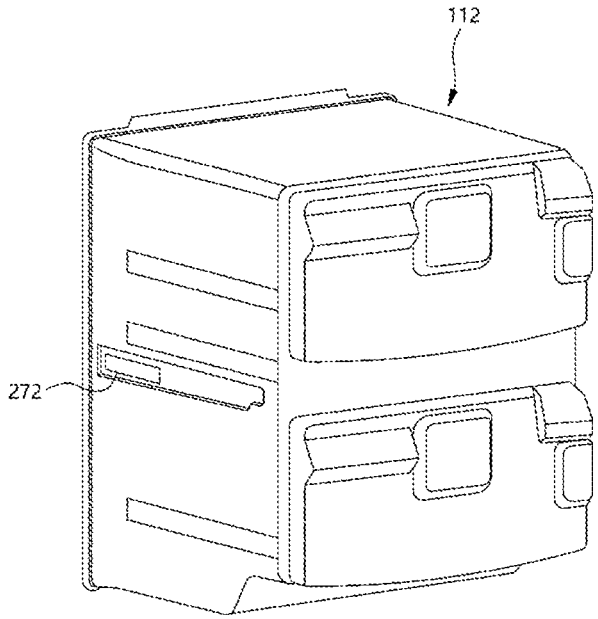
FIG. 57 is a rear perspective view illustrating the configuration of the inner casing constituting the exemplary embodiment of the present disclosure.
Figure 58:
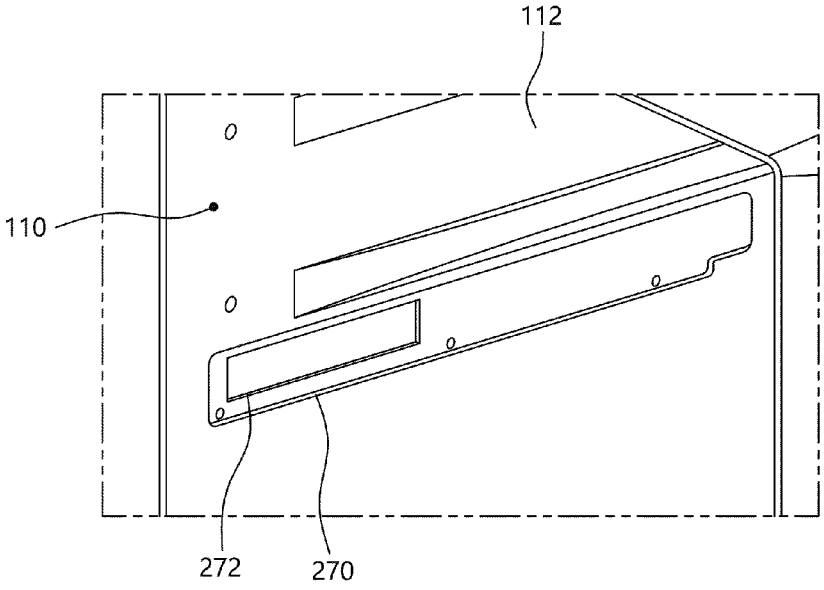
FIG. 58 is an enlarged perspective view illustrating a configuration of the barrier mounting groove constituting the exemplary embodiment of the present disclosure.

FIG. 56 is a front perspective view illustrating a configuration of the inner casing constituting the exemplary embodiment of the present disclosure. FIG. 57 is a rear perspective view illustrating the configuration of the inner casing constituting the exemplary embodiment of the present disclosure. FIG. 58 is an enlarged perspective view illustrating a configuration of the barrier mounting groove constituting the exemplary embodiment of the present disclosure.

Hereinafter, referring to FIGS. 56 to 58, the inner casing 112 of the refrigerator according to the exemplary embodiment of the present disclosure will be described in detail.

The inner casing 112 is formed in a chamber shape having an open front side, and is a part installed on the rear surface part of the front frame part 200. A barrier module 600, which will be described later, is installed in the center of the inner casing 112, so that inner upper and lower sides of the inner casing 112 are respectively partitioned into the first and second inner casings 114 and 116.

A barrier mounting groove 270 is formed in a center of each inner side surface of the inner casing 112. As shown in FIG. 58, the barrier mounting groove 270 is formed in a rectangular shape in the center of each inner side surface of the inner casing 112, is formed long forward and backward, and is formed to be recessed by a predetermined depth in each inner side surface of the inner casing 112. The interior of the barrier mounting groove 270 is a part into which an inner casing fixing part 616 formed on each side surface of the barrier module 600 to be described later is inserted to allow the barrier module 600 to be described later to be fixed to the inner casing 112.

That is, the barrier mounting grooves 270 are respectively formed in centers of inner left and right wall surfaces of the inner casing 112, and the opposite sides of the barrier module 600 to be described later are inserted thereinto, so that the barrier module 600 to be described later may be firmly fixed to the inside of the inner casing 112.

A barrier fixing hole 272 is formed on an inner surface of each barrier mounting groove 270. The barrier fixing hole 272 is formed in a rectangular hole shape, is formed long forward and backward, and is formed to pass through leftward and rightward in the front side of the inner surface of the barrier mounting groove 270. The interior of the barrier fixing hole 272 is a part into which a barrier fixing part 618 of the barrier module 600 to be described later is inserted to allow the barrier module 600 to be described later to be further fixed.

Due to the structure of the barrier mounting groove 270 and the barrier fixing hole 272 of the inner casing 112 as described above, the installation of the barrier module 600 to be described later that partitions the interior of the inner casing 112 into the first and second inner casings 114 and 116 may be easily performed by a simple operation of an operator.

In addition, due to the structure of the barrier mounting groove 270 and the barrier fixing hole 272 of the interior of the inner casing 112, when the barrier module 600 to be described later fails or breaks, the attachment and detachment of the barrier module 600 may be easily performed by the simple operation of the operator.

Figure 59:
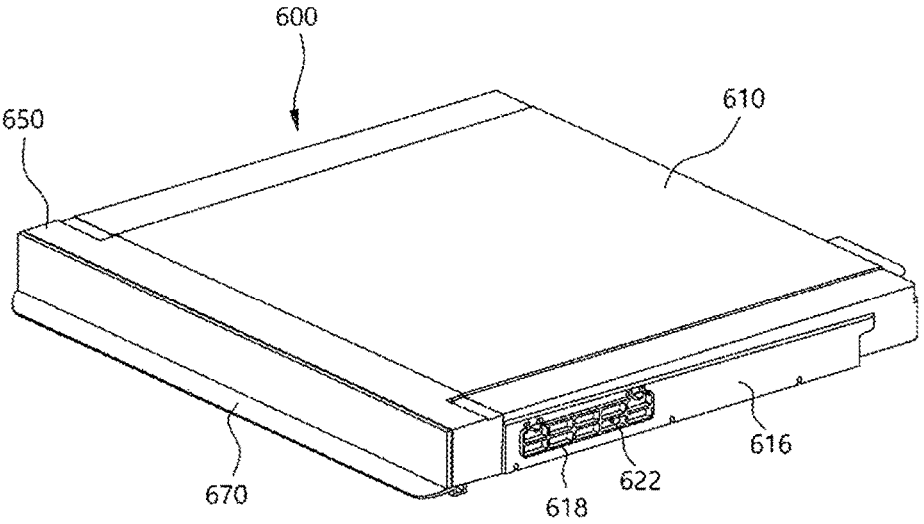
FIG. 59 is a perspective view illustrating the configuration of the barrier module constituting the exemplary embodiment of the present disclosure.
Figure 60:
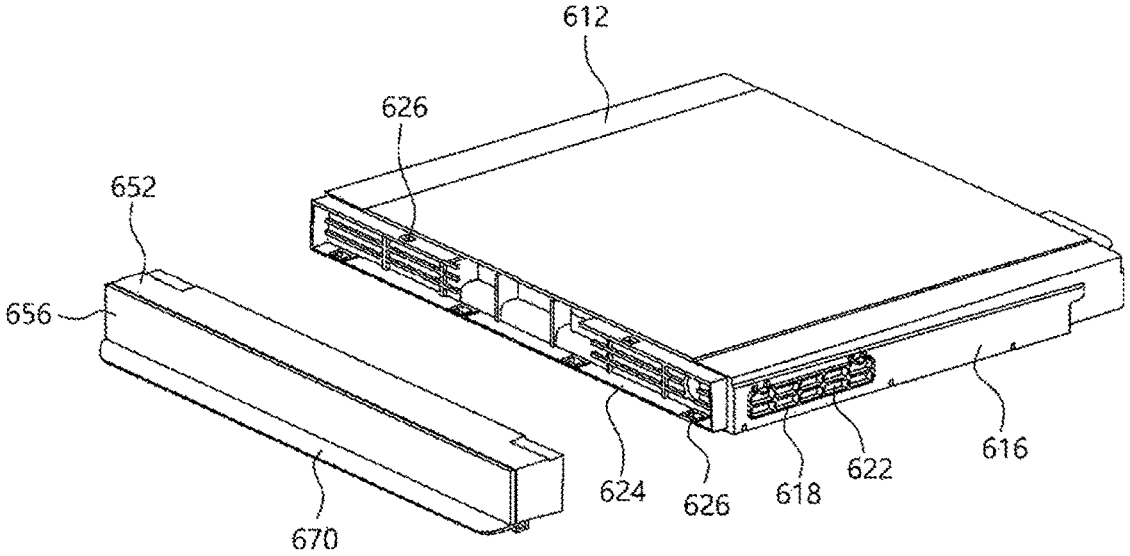
FIG. 60 is an exploded perspective view illustrating a state in which a barrier body part and an operation panel part constituting the exemplary embodiment of the present disclosure are separated.
Figure 61:
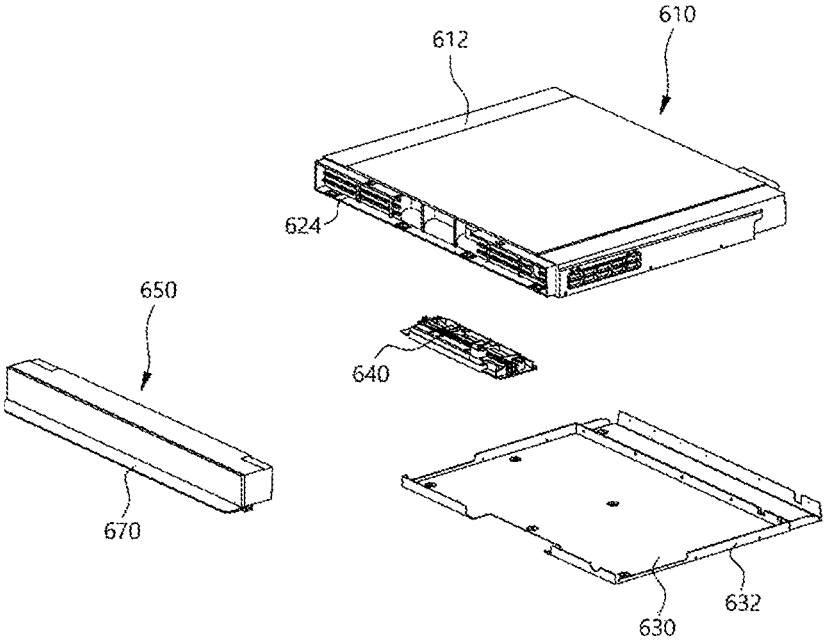
FIG. 61 is an exploded perspective view illustrating the configuration of the barrier module constituting the exemplary embodiment of the present disclosure.
Figure 62:
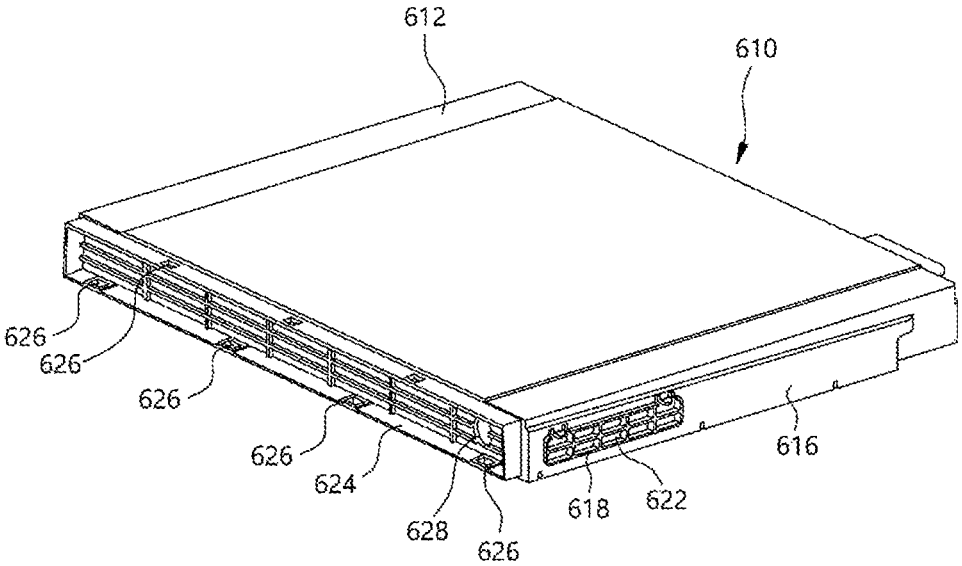
FIG. 62 is a perspective view illustrating a configuration of the barrier body part constituting the exemplary embodiment of the present disclosure.
Figure 63:
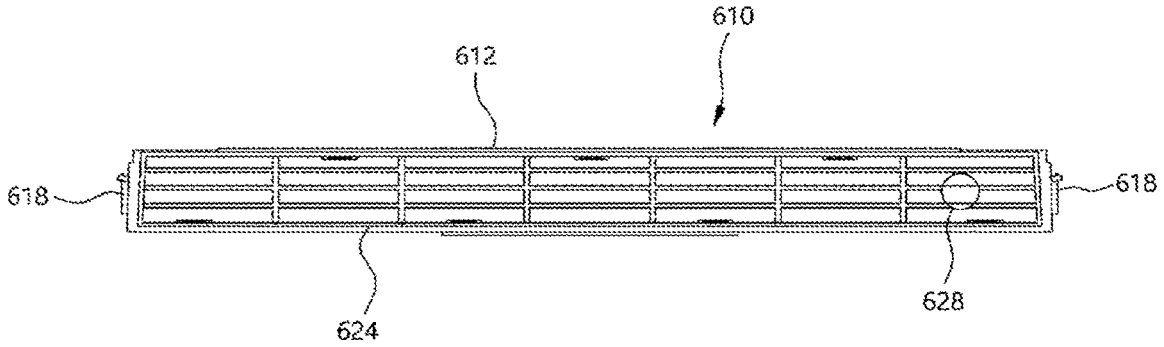
FIG. 63 is a front view illustrating the configuration of the barrier body part constituting the exemplary embodiment of the present disclosure.
Figure 64:
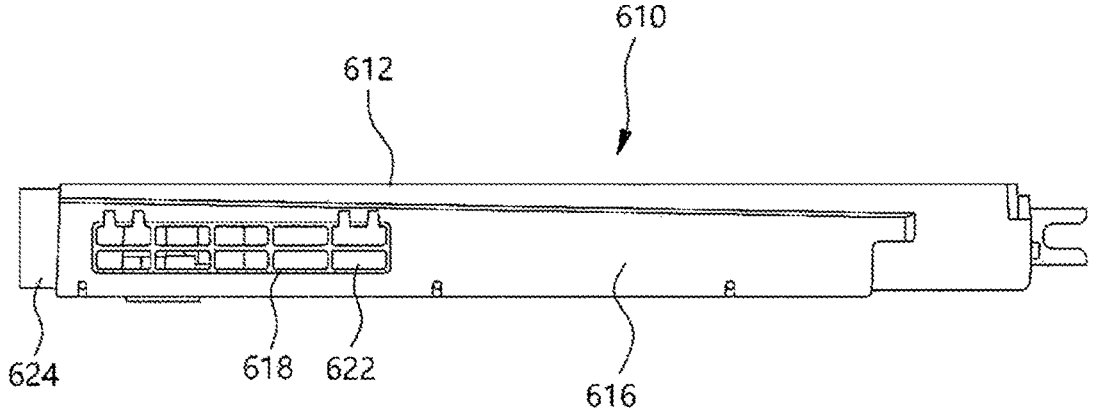
FIG. 64 is a side view illustrating the configuration of the barrier body part constituting the exemplary embodiment of the present disclosure.
Figure 65:
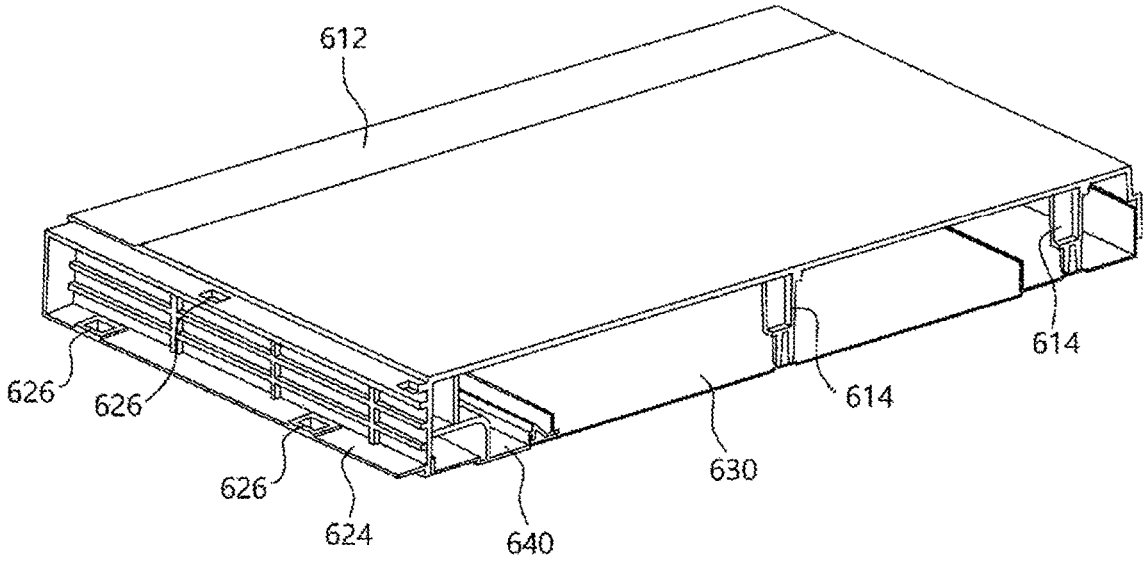
FIG. 65 is a cross-sectional perspective view illustrating an internal structure of the barrier body part constituting the exemplary embodiment of the present disclosure.
Figure 66:
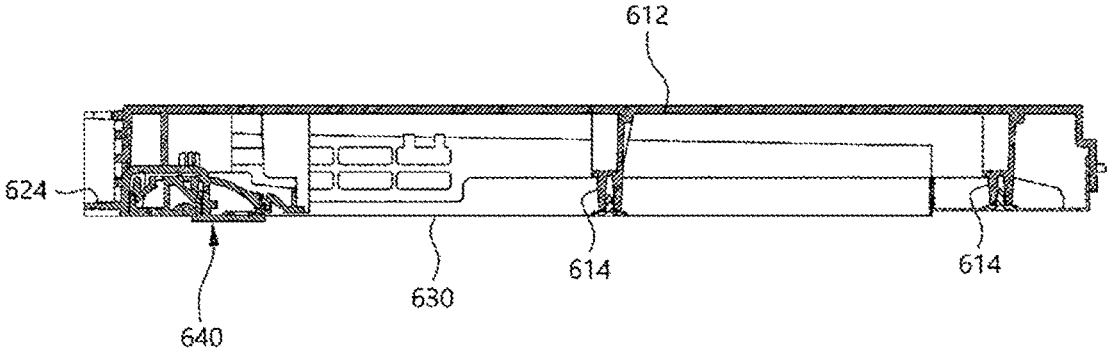
FIG. 66 is a cross-sectional view illustrating the configuration of the barrier body part constituting the exemplary embodiment of the present disclosure.
Figure 67:
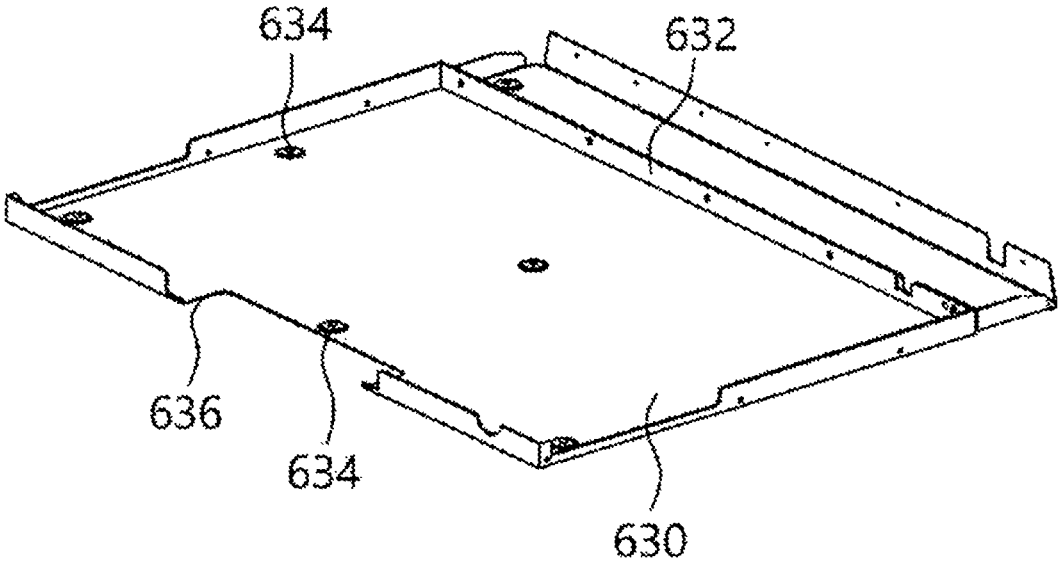
FIG. 67 is a perspective view illustrating a configuration of a barrier bottom plate constituting the exemplary embodiment of the present disclosure.
Figure 68:
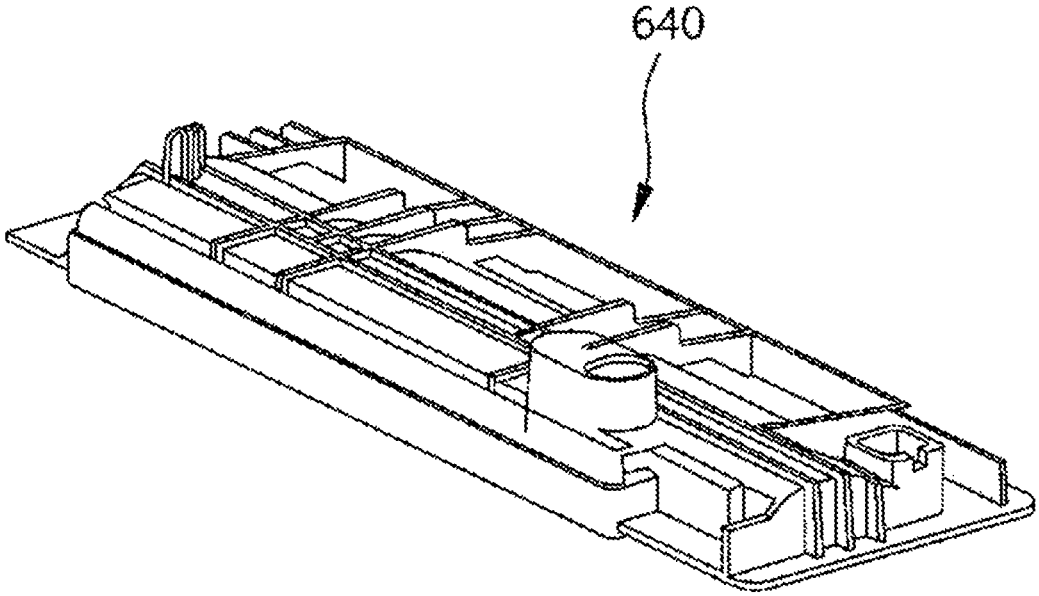
FIG. 68 is a perspective view illustrating a configuration of a lighting unit constituting the exemplary embodiment of the present disclosure.

FIG. 59 is a perspective view illustrating the configuration of the barrier module constituting the exemplary embodiment of the present disclosure. FIG. 60 is an exploded perspective view illustrating a state in which a barrier body part and an operation panel part constituting the exemplary embodiment of the present disclosure are separated. FIG. 61 is an exploded perspective view illustrating the configuration of the barrier module constituting the exemplary embodiment of the present disclosure. FIG. 62 is a perspective view illustrating a configuration of the barrier body part constituting the exemplary embodiment of the present disclosure. FIG. 63 is a front view illustrating the configuration of the barrier body part constituting the exemplary embodiment of the present disclosure. FIG. 64 is a side view illustrating the configuration of the barrier body part constituting the exemplary embodiment of the present disclosure. FIG. 65 is a cross-sectional perspective view illustrating an internal structure of the barrier body part constituting the exemplary embodiment of the present disclosure. FIG. 66 is a cross-sectional view illustrating the configuration of the barrier body part constituting the exemplary embodiment of the present disclosure. FIG. 67 is a perspective view illustrating a configuration of a barrier bottom plate constituting the exemplary embodiment of the present disclosure. FIG. 68 is a perspective view illustrating a configuration of a lighting unit constituting the exemplary embodiment of the present disclosure.

Referring to FIGS. 59 to 68, the barrier module 600 of the refrigerator according to the exemplary embodiment of the present disclosure will be described in detail.

The barrier module 600 is configured to include: a barrier body part 610 installed inside the inner casing 112 to partition the inner casing 112 into first and second inner casings 114 and 116; an operation panel part 650 fixedly installed on one side of the barrier body part 610 and configured to have an operation panel 656 installed on a front side to perform various controls of a refrigerator and to display various states of the refrigerator to outside; and the like.

In addition, the barrier body part 610 is configured to include: a barrier body 612 formed in a box shape having an open lower surface thereof and formed horizontally long; a barrier bottom plate 630 installed on a lower surface of the barrier body 612 and configured to close an open lower surface of the barrier body 612; and the like.

As shown in FIG. 62, the barrier body 612 is formed in a square box shape, and is formed horizontally long. The lower surface of the barrier body 612 has an open shape, and the barrier bottom plate 630 to be described later is installed on the lower surface of the barrier body 612. The barrier body 612 is installed inside the inner casing 112, and serves to partition the inner casing 112 into first and second inner casings 114 and 116.

In addition, the interior of the barrier body 612 may be filled with a foam material, and accordingly, cold air of the first and second inner casings 114 and 116 partitioned by the barrier body 612 may be prevented from being transmitted to each other.

A coupling protrusion 614 is formed on an inner side upper surface of the barrier body 612. As shown in FIG. 65, the coupling protrusion 614 is formed in a cylindrical shape, and is formed to protrude from the inner upper surface of the barrier body 612 in a downward direction. A plurality of coupling protrusions 614 is a part formed to protrude at predetermined intervals from the inner upper surface of the barrier body 612 to allow the barrier bottom plate 630, which will be described later, to be fixed.

An inner casing fixing part 616 is formed on a side surface of the barrier body 612. As shown in FIG. 62, the inner casing fixing part 616 is formed in a shape corresponding to the barrier mounting groove 270, and is formed to protrude from the side surface of the barrier body 612 in the left or right direction. The inner casing fixing part 616 is coupled to the inside of the barrier mounting groove 270, and serves to fix the barrier module 600 to the interior of the inner casing 112.

That is, the inner casing fixing parts 616 are respectively formed to protrude from opposite side surfaces of the barrier body 612, and are respectively inserted into the interiors of the barrier mounting grooves 270, so that the barrier module 600 is fixed to the inner casing 112, whereby the inner casing 112 may be divided into first and second inner casings 114 and 116.

A barrier fixing part 618 is formed on a side surface of the inner casing fixing part 616. The barrier fixing part 618 is formed on a front side of the side surface of the inner casing fixing part 616, and is formed in a shape corresponding to the barrier fixing hole 272.

The barrier fixing part 618 is formed to protrude by a predetermined length in the leftward or rightward direction of the inner casing fixing part 616. The barrier fixing part 618 is a part inserted into the barrier fixing hole 272 to additionally fix the barrier body 612 to the inner casing 112.

Barrier fixing hooks 620 are formed on an upper surface of the barrier fixing part 618. The barrier fixing hooks 620 have a hook shape, and are respectively formed to protrude from front and rear sides of the upper surface of the barrier fixing part 618 in an upward direction. The barrier fixing hooks 620 are caught and fixed to respective upper side edge parts of the barrier fixing holes 272, and serve to fix the barrier body 612 to the inner casing 112.

As described above, the inner casing fixing part 616 and the barrier fixing part 618 are respectively coupled to the barrier mounting groove 270 and the barrier fixing hole 272, which are formed in the inner casing 112, and the barrier fixing hooks 620 are caught and fixed to the respective barrier fixing holes 272, whereby not only the barrier module 600 may be firmly fixed inside the inner casing 112, but also the attachment and detachment may be easily performed by the simple operation of the operator in an event when the barrier module 600 fails or breaks.

A foam material filling hole 622 is formed on a side surface of the barrier fixing part 618. The foam material filling hole 622 is formed in a square hole shape, and a plurality of foam material filling holes 622 is formed to pass through leftward and rightward in each side surface of the barrier fixing part 618 at predetermined intervals. Each foam material filling hole 622 communicates with the interior of the barrier body 612 and serves as a passage through which the foam material may be injected into the barrier body 612.

An operation panel fixing end 624 is formed on a front surface of the barrier body 612. The operation panel fixing end 624 is formed to protrude forward by a predetermined length from along a front edge part of the barrier body 612. The operation panel fixing end 624 is a part formed to protrude to a front side of the barrier body 612 to be inserted into the interior of an operation panel body 652 to be described later.

The operation panel fixing holes 626 are formed in upper and lower surfaces of the operation panel fixing end 624. Each operation panel fixing hole 626 is formed in a square hole shape, and is formed to pass through upward and downward in the upper and lower surfaces of the operation panel fixing end 624. A plurality of the operation panel fixing holes 626 is a part formed to pass through the upper and lower surfaces of the operation panel fixing end 624 at predetermined intervals and to which the barrier fixing hooks 620 of the operation panel body 652 to be described later are caught and fixed.

That is, in a state where the operation panel body 652 to be described later is inserted into the outer surface of the operation panel fixing end 624, the barrier fixing hooks 620 to be described later are inserted into the operation panel fixing holes 626, so that an operation panel part 650 to be described later may be firmly fixed to the front side of the barrier body 612.

An operation panel wiring hole 628 is formed on the front surface of the barrier body 612. The operation panel wiring hole 628 is formed to pass through forward and backward on the right side of the front surface of the barrier body 612. The operation panel wiring hole 628 serves as a passage for guiding various connection wires (not shown) of the operation panel part 650 installed on the front surface of the barrier body 612 into the barrier body 612.

A barrier bottom plate 630 is installed on a lower surface of the barrier body 612. The barrier bottom plate 630 is formed in a rectangular flat plate shape, and is installed in an open part of the lower surface of the barrier body 612 to close the open part of the lower surface of the barrier body 612.

A barrier coupling end 632 is formed on an upper surface of the barrier bottom plate 630. The barrier coupling end 632 is vertically bent and formed in an upward direction along an outer side edge part of the barrier bottom plate 630. The barrier coupling end 632 is a part in close contact with an inner wall of the barrier body 612 to fix the barrier bottom plate 630 to the lower part of the barrier body 612.

Barrier body fastening holes 634 are formed on an upper surface of the barrier bottom plate 630. A plurality of the barrier body fastening holes 634 is formed on the upper surface of the barrier bottom plate 630 to pass through upward and downward at predetermined intervals. The barrier body fastening holes 634 are formed at respective positions corresponding to the coupling protrusions 614 of the barrier body 612. A fastening screw (not shown) is installed to pass through inside the barrier body fastening hole 634, and is screw-coupled to the coupling protrusion 614, so that the barrier body 612 and the barrier bottom plate 630 may be firmly fixed.

A lighting unit mounting hole 636 is formed in the front side of the upper surface of the barrier bottom plate 630. The lighting unit mounting hole 636 is formed in a rectangular box shape, is formed horizontally long, and is formed to pass through upward and downward in a front center of the upper surface of the barrier floor plate 630.

That is, a lighting unit 640, which will be described later, is mounted on the upper surface of the lighting unit mounting hole 636, and the lighting unit 640 is a part to emit light to illuminate the interior of the second storage chamber 116.

The lighting unit 640 is installed on the upper surface of the barrier bottom plate 630. The lighting unit 640 is a general lighting device and a detailed description thereof will be omitted. The lighting unit 640 is installed on the upper surface of the barrier bottom plate 630, and serves to emit light to illuminate the interior of the second inner casing 116 through the lighting unit mounting hole 636.

By the structure of the barrier body part 610 as described above, it is easy to assemble the barrier body part 610 that partitions the interior of the inner casing 112. Furthermore, as the foam material filling hole 622 is formed in a side surface of the barrier body part 610 and the foam material is filled in the interior of the barrier body part 610, insulation is conducted between the first and second inner casings 114 and 116.

In addition, by the barrier module 600, not only the upper and lower sides of the inner casing 112 may be formed as respective independent storage spaces of the first inner casing 114 and the second storage chamber 116, but also different refrigeration temperatures of the first and second inner casings 114 and 116 may be used.

Figure 69:
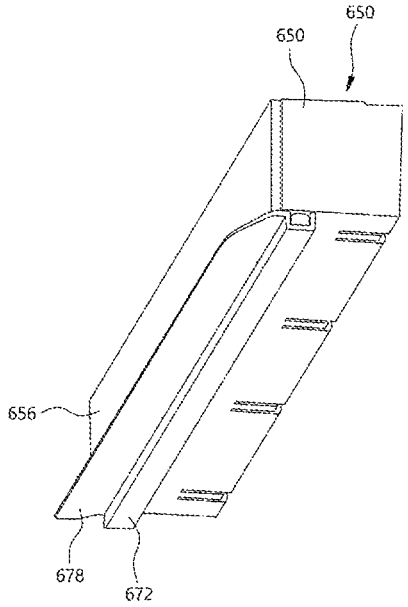
FIG. 69 is a perspective view illustrating a state in which a cold air blocking member is coupled to the operation panel part constituting the exemplary embodiment of the present disclosure.
Figure 70:
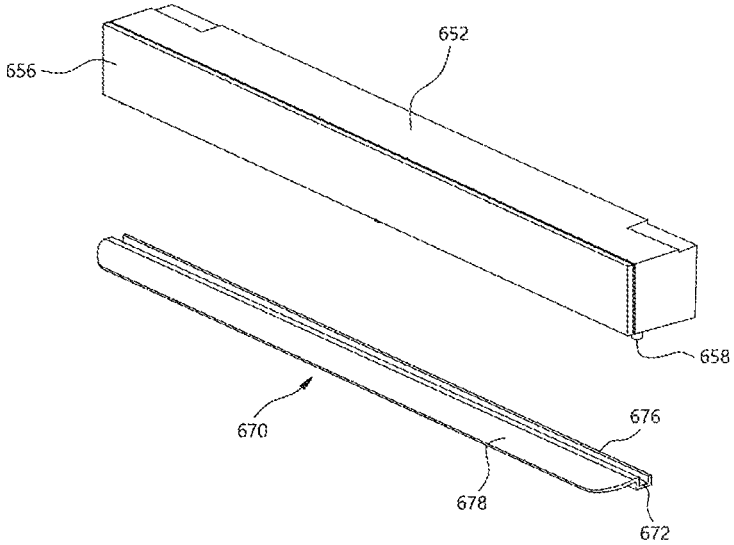
FIG. 70 is a perspective view illustrating a state in which the cold air blocking member is separated from the operation panel part constituting the exemplary embodiment of the present disclosure.
Figure 71:
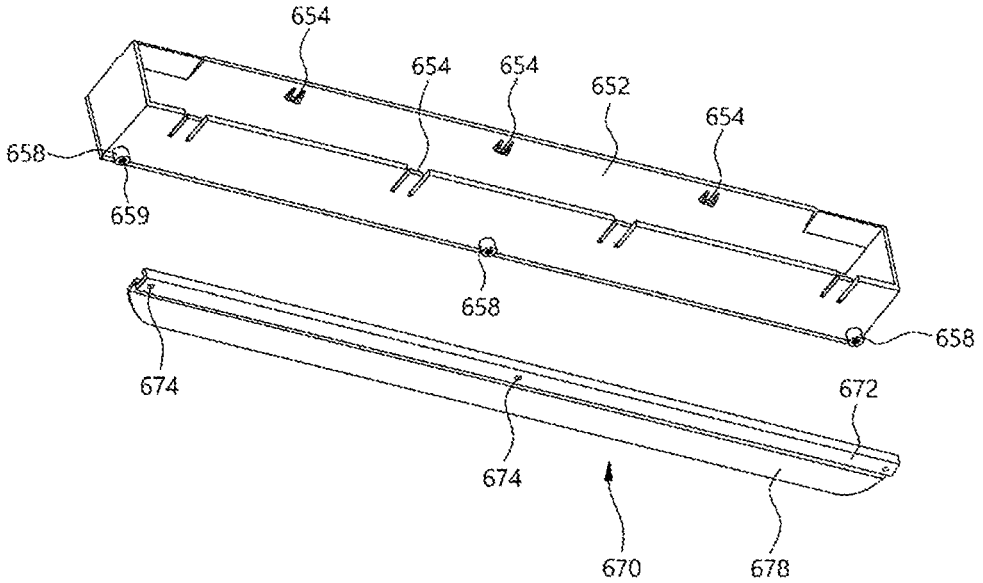
FIG. 71 is a bottom perspective view illustrating a state in which the cold air blocking member is separated from the operation panel part constituting the exemplary embodiment of the present disclosure.
Figure 72:
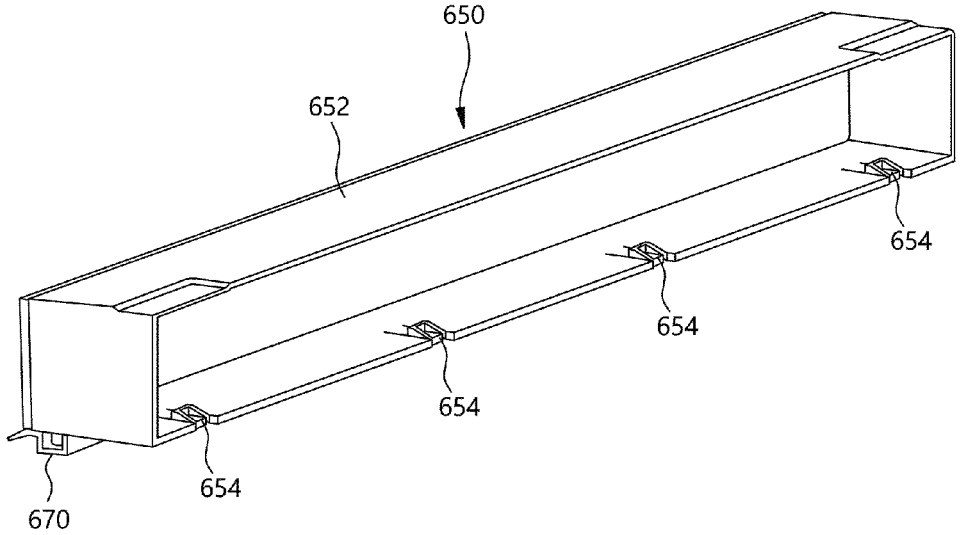
FIG. 72 is a rear perspective view illustrating a configuration of the operation panel part constituting the exemplary embodiment of the present disclosure.
Figure 73:
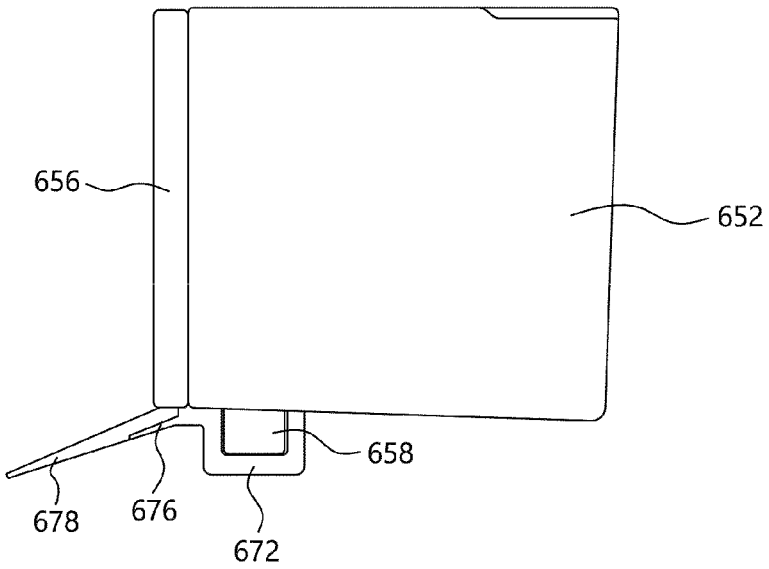
FIG. 73 is a cross-sectional view illustrating the configuration of the operation panel part constituting the exemplary embodiment of the present disclosure.
Figure 74:
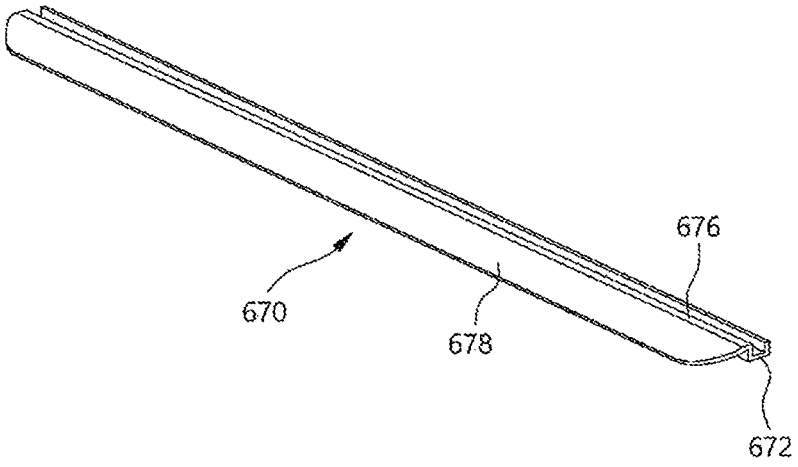
FIG. 74 is a perspective view illustrating a configuration of the cold air blocking member constituting the exemplary embodiment of the present disclosure.

FIG. 69 is a perspective view illustrating a state in which the cold air blocking member is coupled to the operation panel part constituting the exemplary embodiment of the present disclosure. FIG. 70 is a perspective view illustrating a state in which the cold air blocking member is separated from the operation panel part constituting the exemplary embodiment of the present disclosure. FIG. 71 is a bottom perspective view illustrating a state in which the cold air blocking member is separated from the operation panel part constituting the exemplary embodiment of the present disclosure. FIG. 72 is a rear perspective view illustrating a configuration of the operation panel part constituting the exemplary embodiment of the present disclosure. FIG. 73 is a cross-sectional view illustrating the configuration of the operation panel part constituting the exemplary embodiment of the present disclosure. FIG. 74 is a perspective view illustrating a configuration of the cold air blocking member constituting the exemplary embodiment of the present disclosure.

Referring to FIGS. 69 to 74, the operation panel part 650 of the refrigerator according to the exemplary embodiment of the present disclosure will be described in detail The operation panel part 650 is installed at a position on a front side of the barrier body part 610. The operation panel part 650 is configured to include: an operation panel body 652 formed in a rectangular box shape having an open rear side and formed horizontally long; an operation panel 656 installed on a front surface of the operation panel body 652 and configured to control the refrigerator according to a user's operation; and the like.

The operation panel body 652 is formed in a square box shape having an open rear side, and is formed horizontally long. The operation panel body 652 is a part installed on the front surface of the barrier body part 610 and to which a plurality of parts are fixed.

Operation panel fixing hooks 654 are formed on the upper and lower surfaces of the rear side of the operation panel body 652. Each operation panel fixing hook 654 is formed in a hook shape, and is formed to protrude from the upper or lower surface of the operation panel body 652 in an upward or downward direction. A plurality of the operation panel fixing hook 654 is formed to protrude from the upper and lower surfaces of the operation panel body 652 at predetermined intervals. The operation panel fixing hook 654 is a part inserted into the interior of the operation panel fixing hole 626 to be caught and fixed to the barrier body part 610.

That is, the operation panel fixing end 624 of the barrier body part 610 is inserted into the interior of the operation panel body 652, and at the same time, the operation panel fixing hooks 654 are inserted into the respective operation panel fixing holes 626, so that the operation panel body 652 may be firmly fixed to the barrier body part 610.

The operation panel 656 is installed on the front surface of the operation panel body 652. The operation panel 656 may be configured to enable touch-type operation, or may be configured to enable button-type or switch-type operation.

In addition, a display part (not shown) composed of LED modules is formed on a part of the operation panel 656, so as to display various types of control information of the refrigerator using the touch-type, button-type, or switch-type operation to the outside.

The operation panel 656 is installed on a front surface part of the operation panel body 652, so that a user may set various functions of the refrigerator, and display control information of the refrigerator and external environment information (i.e. external temperature, humidity, etc.) of the refrigerator to the outside through the see-through window 182 part of the door 130.

A blocking member fixing protrusion 658 is formed on the lower surface of the operation panel body 652. As shown in FIG. 71, the blocking member fixing protrusion 658 is formed in a cylindrical shape, is provided with a screw fastening hole 659 to be described later formed on a lower surface thereof, and is formed to protrude from a front side of the lower surface of the operation panel body 652 in a downward direction. A plurality of the blocking member fixing protrusions 658 is formed to protrude from the lower surface of the operation panel 656 at predetermined intervals.

A screw fastening hole 659 in which a thread is formed on an inner circumferential surface thereof is formed on a lower surface of each blocking member fixing protrusion 658. A blocking member fixing part 672, which will be described later, is a part that is screw-coupled and fixed to an outer surface of the blocking member fixing protrusion 658.

A cold air blocking member 670 is installed on the outer surface of the blocking member fixing protrusion 658. The cold air blocking member 670 is made of a flexible material and is in close contact with the door 130, so as to serve to prevent the cold air of the first and second inner casings 114 and 116 from circulating through a space between the door 130 and the operation panel part 650.

Hereinafter, the cold air blocking member 670 is configured to include: a blocking member fixing part 672 formed in a rectangular frame shape having an open upper side thereof, formed horizontally long, and into which a fixing protrusion 658 is inserted and fixed; a blocking member extension part 676 formed to protrude forward from along an upper edge part of the blocking member fixing part 672, and to be in close contact with a bottom surface of an operation panel body 652; and a blocking plate 678 formed to be inclined forward at a predetermined angle from along an end of the blocking member extension part 676, and to be in close contact with a rear surface part of a door 130 to block circulation of cold air flowing between first and second inner casings 114 and 116.

The blocking member fixing part 672 is formed in a rectangular frame shape having a cavity with an open upper side thereof, and is formed horizontally long. The blocking member fixing part 672 is coupled to an outer side of the fixing protrusion 658 through an upper side open part. The blocking member fixing part 672 is installed at a position on the front side of the lower surface of the operation panel body 652, and serves to support the blocking plate 678 to be described later.

A fixing protrusion mounting holes 674 passing through upward and downward are formed on a lower surface of the blocking member fixing part 672. The fixing protrusion mounting holes 674 are formed to pass through the lower surface of the blocking member fixing part 672 at predetermined intervals. A fastening screw (not shown) is installed inside each fixing protrusion mounting hole 674, so that the blocking member fixing part 672 may be firmly fixed to the blocking member fixing protrusion 658.

A blocking member extension part 676 is formed in a front of an upper side of the blocking member fixing part 672. The blocking member extension part 676 is formed to protrude forward from along a front side edge part of an upper part of the blocking member fixing part 672. One end of the blocking member extension part 676 is connected to the blocking member fixing part 672 and the other end of the blocking member extension part 676 is connected to a blocking plate 678 to be described later. The blocking member extension part 676 extends to the front side of the blocking member fixing part 672 to support the blocking plate 678 to be described later.

The blocking plate 678 is formed at a position on the front side of the blocking member extension part 676. The blocking plate 678 is made of a flexible material, is formed horizontally long along a front surface of the blocking member extension part 676, and is formed to protrude obliquely downward to a rear surface side of the door 130.

In addition, the blocking plate 678 is formed to have a thickness thereof gradually thinner as it goes toward the end thereof. The blocking plate 678 is in close contact with the rear surface part of the door 130, so as to serve to block the cold air of the first and second inner casings 114 and 116 from circulating through a space between the door 130 and the operation panel part 650.

In addition, as the blocking plate 678 is formed to have the thickness thereof gradually thinner as it goes toward the end thereof, a part in contact with the rear surface side of the door 130 is in close contact with an end part of the blocking plate 678 gently, so that damage to the door 130 due to the contact of the blocking plate 678 may be minimized.

That is, the blocking plate 678 is made of a flexible material and is in close contact with the rear surface side of the door 130, and because of this, when the door 130 is positioned on a front side of the operation panel part 650 due to a closing operation of the door 130, the blocking plate 678 blocks the space between the door 130 and the operation panel 656, thereby preventing the circulation of cold air in the first and second inner casings 114 and 116.

The scope of the present disclosure is not limited to the exemplary embodiments illustrated above, and within the technical scope as described above, many other modifications based on the present disclosure will be possible for those skilled in the art.

The invention claimed is:

1. A refrigerator, comprising:

an outer casing that defines an exterior of the refrigerator;

a first inner casing that is disposed at an inner upper side of the outer casing and defines a first storage chamber;

a second inner casing that is disposed at an inner lower side of the outer casing and defines a second storage chamber; and a front frame part that is disposed at front sides of the outer casing, the first inner casing, and the second inner casing, wherein the first inner casing and the second inner casing are coupled to a rear surface of the front frame part and vertically spaced apart from each other, wherein the front frame part comprises:

a front frame that blocks a space defined between the outer casing and a circumference of each of the first and second inner casings, and a middle exterior frame that blocks a space defined between the first inner casing and the second inner casing, wherein the refrigerator further comprises:

a door configured to open and close at least one of the first storage chamber or the second storage chamber, and a shielding member made of a flexible material and disposed at the middle exterior frame, the shielding member extending horizontally along a lower surface of the middle exterior frame and protruding toward an inner side of each of the first and second inner casings, wherein the shielding member is configured to block cold air flowing upward along a rear surface of the door, wherein each of the first and second inner casings comprises a coupling part that is disposed at a front edge thereof and extends outward from the front edge, and wherein the front frame further comprises:

an inner casing coupling end that is inserted and fixed to an inner surface of the coupling part, and an insertion depth adjustment jaw that is disposed at the inner casing coupling end and protrudes in a left direction or a right direction, the insertion depth adjustment jaw being configured to limit an insertion depth of each of the first and second inner casings based on an inner surface of each of the first and second inner casings being coupled to an outer surface of the inner casing coupling end.

2. The refrigerator of claim 1, wherein the front frame defines an opening, and wherein the inner casing coupling end comprises:

a first edge end that extends horizontally along an upper side edge of the opening and protrudes rearward from the front frame;

second edge ends that extend vertically along left and right side edges of the opening and protrude rearward from the front frame; and a third edge end that extends horizontally along a lower side edge of the opening and protrudes rearward from the front frame.

3. The refrigerator of claim 2, wherein each of the second edge ends defines a middle exterior frame mounting hole that passes therethrough in the left direction or the right direction and receives a side of the middle exterior frame.

4. The refrigerator of claim 3, wherein the middle exterior frame comprises:

a middle frame body that extends horizontally across a center part of the front frame and covers a center portion of the opening; and auxiliary coupling ends that are disposed at upper and lower side ends of the middle frame body and extend horizontally along the middle frame body, the auxiliary coupling ends protruding rearward from the middle frame body and being inserted into the inner surface of each of the first and second inner casings.

5. The refrigerator of claim 4, wherein the front frame further comprises:

a screw fastening protrusion that is disposed at a center part of a rear surface of the front frame, the screw fastening protrusion having a screw fastening groove defined therein.

6. The refrigerator of claim 5, wherein the middle exterior frame further comprises:

a corner end wall that extends from a side end of each of the auxiliary coupling ends and defines a curved surface curved upward or downward;

a side surface fixing end wall that is disposed at an end of the corner end wall and extends vertically upward or downward from the corner end wall, the side surface fixing end wall being in contact with one of the second edge ends; and a frame fixing protrusion that protrudes from the side surface fixing end wall and extends rearward toward the inner casing, the frame fixing protrusion defining a screw fastening hole coupled to the screw fastening protrusion.

7. The refrigerator of claim 1, wherein the shielding member comprises:

a shielding member fixing part fixed to the lower surface of the middle exterior frame; and a shielding part disposed at an end of the shielding member fixing part and inclined downward, the shielding part extending toward the inner side of each of the first and second inner casings and being configured to block the cold air flowing upward along the rear surface of the door.

8. The refrigerator of claim 1, further comprising a barrier module that is disposed between the first inner casing and the second inner casing and divides the first storage chamber and the second storage chamber from each other.

9. The refrigerator of claim 8, wherein the barrier module is detachably installed between the first inner casing and the second inner casing.

10. The refrigerator of claim 8, wherein the first and second inner casings define:

a barrier mounting groove that is provided at an inner side surface of the first and second inner casings and receives opposite side parts of the barrier module; and a barrier fixing hole that is provided in the barrier mounting groove and passes through the inner side surface of the first and second inner casings in the left direction or the right direction, and wherein a part of the barrier module passes through the barrier fixing hole.

11. The refrigerator of claim 10, wherein the barrier module comprises:

a barrier body that is disposed in the first and second inner casings and partitions the first storage chamber and the second storage chamber from each other; and an operation panel disposed at a front surface of the barrier body and configured to control the refrigerator and to display a plurality of states of the refrigerator.

12. The refrigerator of claim 11, wherein the barrier module further comprises an inner casing fixed part that is disposed at a side surface of the barrier body and has a shape corresponding to the barrier mounting groove, the inner casing fixed part protruding from the side surface of the barrier body in the left direction or the right direction and being inserted into the barrier mounting groove.

13. The refrigerator of claim 12, wherein the inner casing fixed part comprises a barrier fixing part that has a shape corresponding to the barrier fixing hole, the barrier fixing part protruding from a side surface of the inner casing fixing part in the left direction or the right direction and being inserted into the barrier fixing hole.

14. The refrigerator of claim 8, wherein the barrier module further comprises a cold air blocking member made of a flexible material and disposed at a lower part of the barrier module, the cold air blocking member horizontally extending along a front side of the barrier module, and wherein the cold air blocking member is configured to contact the rear surface of the door to thereby block a flow of cold air between the first storage chamber and the second storage chamber.

15. The refrigerator of claim 14, wherein the cold air blocking member comprises:

a blocking member fixing part fixed to the lower part of the barrier module; and a blocking plate disposed at an end of the blocking member fixing part and inclined downward, the blocking plate extending toward the door and being configured to contact the rear surface of the door.

* * * * *